US008957354B2

(12) United States Patent
Fujita et al.

(10) Patent No.: US 8,957,354 B2
(45) Date of Patent: Feb. 17, 2015

(54) INDUCTIVE HEATING DEVICE

(75) Inventors: Atsushi Fujita, Shiga (JP); Makoto Imai, Shiga (JP); Hideki Sadakata, Shiga (JP); Yuta Miura, Shiga (JP); Shinichiro Sumiyoshi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 936 days.

(21) Appl. No.: 13/123,339

(22) PCT Filed: May 13, 2009

(86) PCT No.: PCT/JP2009/002084

§ 371 (c)(1),
(2), (4) Date: Apr. 8, 2011

(87) PCT Pub. No.: WO2010/041354

PCT Pub. Date: Apr. 15, 2010

(65) Prior Publication Data

US 2011/0192838 A1 Aug. 11, 2011

(30) Foreign Application Priority Data

Oct. 8, 2008 (JP) ..... 2008-261439
Apr. 3, 2009 (JP) ..... 2009-091091

(51) Int. Cl.
*H05B 6/04* (2006.01)
*H05B 6/06* (2006.01)

(52) U.S. Cl.
CPC ..... *H05B 6/062* (2013.01)
USPC ..... 219/661; 219/665

(58) Field of Classification Search
CPC ..... H05B 6/062; H03L 5/02
USPC ..... 219/626, 624, 518, 663, 661, 665; 363/16, 132, 37, 97, 98
See application file for complete search history.

(56) References Cited

U.S. PATENT DOCUMENTS 4,820,891 A * 4/1989 Tanaka et al. ..... 219/626
5,341,004 A * 8/1994 Furuhata ..... 257/139
7,015,438 B2 3/2006 Hirota et al.
2003/0210562 A1* 11/2003 Takehara et al. ..... 363/24
2004/0047098 A1* 3/2004 Friedrichs et al. ..... 361/93.1

(Continued)

FOREIGN PATENT DOCUMENTS

CN 1623349 A 6/2005
CN 101297601 A 10/2008

(Continued)

OTHER PUBLICATIONS

International Search Report for International Application No. PCT/JP2009/002084, dated Aug. 11, 2009, 1 page.

(Continued)

*Primary Examiner* — Thien S Tran
(74) *Attorney, Agent, or Firm* — Brinks Gilson & Lione

(57) ABSTRACT

Disclosed is an inductive heating device which can lower losses in the device and readily provide cooling, wherein a controller is operated in a first control mode which controls the operation so that a unipolar first switching element and a unipolar second switching element conduct alternately when one of a bipolar third switching element and a bipolar fourth switching element is conducting and the other is disconnected when an aluminum object to be heated is heated, and in a second control mode in which the conduction of the first switching element and the fourth switching element and the conduction of the second switching element and the third switching element alternate when an iron object to be heated is heated.

20 Claims, 10 Drawing Sheets

(56) References Cited

U.S. PATENT DOCUMENTS

| | | | | |
|---|---|---|---|---|
| 2007/0103951 | A1* | 5/2007 | Ishikawa et al. | 363/146 |
| 2009/0139980 | A1 | 6/2009 | Acero Acero et al. | |
| 2010/0230401 | A1* | 9/2010 | Miyauchi et al. | 219/665 |

FOREIGN PATENT DOCUMENTS

| | | | | | |
|---|---|---|---|---|---|
| JP | 03-269988 | A | | 12/1991 | |
| JP | 06-111928 | A | | 4/1994 | |
| JP | 06-290863 | A | | 10/1994 | |
| JP | 2005149915 | A | * | 6/2005 | H05B 6/12 |
| JP | 2006-331965 | A | | 12/2006 | |
| WO | WO 2007/088931 | A1 | | 8/2007 | |

OTHER PUBLICATIONS

International Preliminary Report on Patentability for International Application No. PCT/JP2009/002084, dated May 17, 2011, 8 pages.

* cited by examiner (a) FIRST SWITCHING ELEMENT OF IGBT (b) FIRST SWITCHING ELEMENT OF MOS-FET

INDUCTIVE HEATING DEVICE

This application is a 371 application of PCT/JP2009/002084 having an international filing date of May 13, 2009, which claims priority to JP2008-261439 filed on Oct. 8, 2008 and JP2009-091091 filed on Apr. 3, 2009, the entire contents of which are incorporated herein by reference.

TECHNICAL FIELD

The present invention relates to an inductive heating device used in a general household, office, restaurant, factory or the like, especially for the purpose of heating aluminum or copper.

BACKGROUND ART

Conventionally, in this kind of inductive heating device, for example, relating to an inductive cooking device, two switching units are provided, and the conduction ratio of each one is varied, and a low ON voltage power element is used in the switching unit of a longer conduction time, and a high-speed switching power element is used in the switching unit of a shorter conduction time, and thereby the loss is decreased (see, for example, patent document 1).

Further, relating to an inductive cooking device, for example, a plurality of switching elements are connected in parallel, and an IGBT of faster switching speed is used in one switching element, and an MCT of lower ON voltage is used in the other switching element, and the IGBT is operated in turn-off mode, and the MCT is operated in turn-on mode, and thus a technology of reducing the loss is known (see, for example, patent document 2).

FIG. 9 is a circuit diagram showing a conventional inductive cooking device disclosed in patent document 2. FIG. 10 is waveform diagram showing the operation of the circuit of the conventional inductive cooking device disclosed in patent document 2.

As shown in FIG. 9, a control circuit 37 turns on a second switching element 35-*b*, which is an MCT of low ON voltage power element, for a predetermined time (18 μs). In succession, in 1 μs before the second switching element 35-*b* is turned off, a first switching element 35-*a* is turned on for 3 μs, and then the first switching element 35-*a* is turned off. This operation is repeated, and a load circuit 34 composed of a heating coil 32 and a resonance capacitor 33 is resonated. A high-frequency current is supplied to the heating coil 32, and a high-frequency magnetic field is generated from the heating coil 32. By this high-frequency magnetic field, an electric power is supplied to a pan placed on the heating coil 32.

PATENT DOCUMENTS

Patent Document 1: JP 3-269988 A
Patent Document 2: JP 6-111928 A

DISCLOSURE OF THE INVENTION

However, in the conventional configuration, a large resonance voltage is generated in the heating coil 32 when the first and second switching elements 35-*a*, 35-*b* are turned off. In particular, when increasing the output of the heating coil 32, a high dielectric strength is required in the first and second switching elements 35-*a*, 35-*b*, and loss reduction of the switching elements is sacrificed.

Further, to increase the output of the heating coil 32, it is effective to increase the voltage of the power supply of the inductive cooking device (for example, change from 100 V commercial power supply to 200 V commercial power supply), but a higher dielectric strength is required in the first and second switching elements 35-*a*, 35-*b* at the same time as mentioned above. Accordingly, in general, the system which uses one or more combinations of series connection of two switching elements of inverter system is adopted and in the system, the switching element voltage is not larger than the supply voltage.

In the configuration as disclosed in patent document 2, however, there is another problem, that is, the number of switching elements to be used is increased.

The present invention is intended to solve the problems of the prior art in the above description, and it is hence a primary object thereof to present an inductive heating device for controlling to operate by selecting either a combination of series connection of two switching elements of unipolar type capable of operating at high speed, or a combination of series connection of two switching elements of bipolar type capable of lowering ON voltage or obtaining at a relatively low cost, depending on the material of the object to be heated or the heating output, thereby realizing low loss or low cost of the switching elements of the device, and easy in cooling design.

To solve the problems of the prior art, the inductive heating device of the present invention includes a smoothing part, a series circuit of a first switching element and a second switching element connected between output ends of the smoothing part, a series circuit of a third switching element and a fourth switching element connected between the output ends, a heating coil for heating a material to be heated inductively, a resonance capacitor connected between a connection point of the first and second switching elements and a connection point of the third and fourth switching elements, for forming a resonance circuit together with the heating coil, and a control part for controlling to vary the magnitude of the resonance current to be supplied in the resonance circuit, between a first mode for controlling and operating to conduct the first and second switching element alternately in a state of conducting either one of the third and fourth switching elements and cutting off the other, and a second mode for conducting the first and fourth switching elements and conducting the second and third switching elements alternately, in which the first and second switching elements are of unipolar type, and the third and fourth switching elements are of bipolar type, and the control part operates in the first mode when heating a material made of aluminum, and operates in the second mode when heating a material made of iron.

Accordingly, in the case of an aluminum material, since the switching element is required to operate at a high frequency, the first mode is selected, one of the third and fourth switching elements is conducted and the other is cut off and the first and second switching elements of series connection of two switching elements of unipolar type capable of operating at high speed are conducted alternately. In the case of an iron material, high speed operation is not required as compared with aluminum, but the voltage duty is higher, and the second mode is selected, that is, the first switching element and the fourth switching element of bipolar type low in ON voltage although high speed operation as in the unipolar type cannot be expected are conducted, and the second switching element and the third switching element of bipolar type are conductive alternately, and by such selecting control and operation, the inductive heating device can be enhanced in output while suppressing the increase of the voltage duty of the switching elements.

The present invention provides an inductive heating device which is capable of increasing the heating output at low cost, preventing excessive increase of loss and voltage duty of the switching elements of the inductive heating device, regardless whether the material to be heated is non-magnetic metal of low resistivity including aluminum or other magnetic metal of high resistivity including iron.

DETAILED DESCRIPTION OF THE PREFERRED EMBODIMENTS

Figure 1:
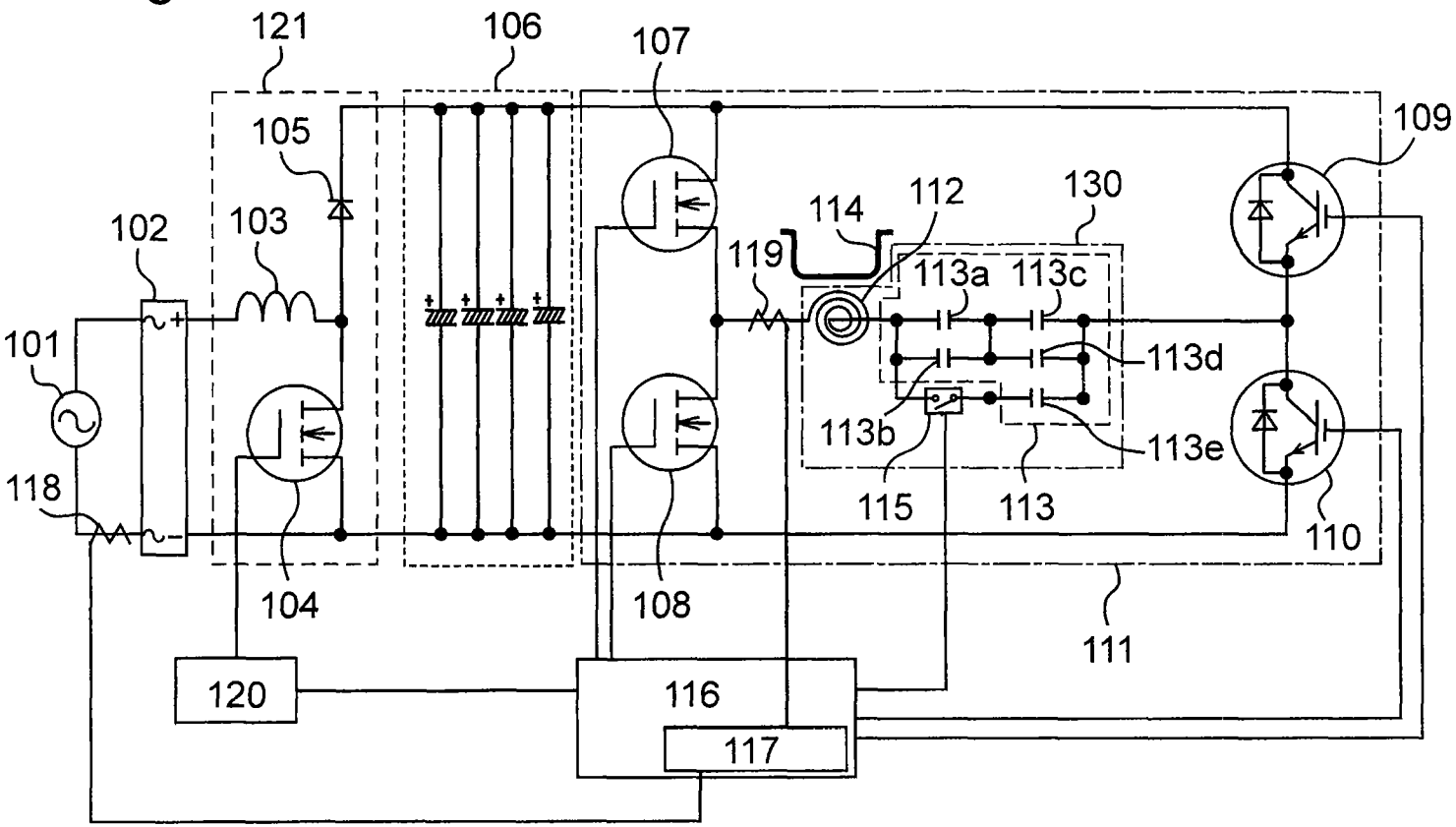
FIG. 1 is a schematic circuit diagram of an inductive heating device in preferred embodiment 1 of the present invention.

A first aspect of the invention relates to an inductive heating device including a smoothing part, a series circuit of a first switching element and a second switching element connected between output ends of the smoothing part, a series circuit of a third switching element and a fourth switching element connected between the output ends, a heating coil for heating a material to be heated inductively, a resonance capacitor connected between a connection point of the first and second switching elements and a connection point of the third and fourth switching elements, for forming a resonance circuit together with the heating coil, and a control part for controlling to vary the magnitude of the resonance current to be supplied in the resonance circuit, between a first mode for controlling and operating to conduct the first and second switching element alternately in a state of conducting either one of the third and fourth switching elements and cutting off the other, and a second mode for conducting the first and fourth switching elements and conducting the second and third switching elements alternately, in which the first and second switching elements are of unipolar type, and the third and fourth switching elements are of bipolar type, and the control part operates in the first mode when heating a material made of aluminum, and operates in the second mode when heating a material made of iron.

When the material to be heated is aluminum or other non-magnetic metal of low resistivity, it is necessary to supply a high-frequency current of 50 kHz or more to the heating coil, and the switching element is required to operate at high frequency. When this switching element is an IGBT or a bipolar type switching element making use of an electron and a hole when passing a current into the inside, when turning on, the hole is injected into the IGBT, and the ON voltage decreased, but when turning off, the voltage applied to the IGBT increased, and the injected hole flows out with a delay (in general called a tail current). Accordingly, in the case of operation at high frequency as mentioned above, the turn-off loss due to tail current increases substantially.

On the other hand, when using a MOS-FET which is a unipolar type switching element making use only of an electron when an electric current flows inside, since any hole is not injected into the MOS-FET when turning on, tail current is not generated when turning off, and the turn-off loss is suppressed.

In such a case where a high-frequency operation is required, the control part of the invention selects the first control mode for controlling and operating to conduct the first and second switching elements alternately in a state of conducting either one of the third and fourth switching elements and cutting off the other. In this first control mode, by conducting the two unipolar type switching elements capable of operating at high speed, the first and second switching elements, alternately, lowering of the loss of the device can be realized.

In the case of alternate conduction of only one set of series connection of two switching elements, the voltage applied to the heating coil and the resonance capacitor ranges from zero to a smoothing capacitor voltage on the basis of one end. Accordingly, the resonance current applicable to the heating coil is limited, and in particular when the number of turns of the heating coil is limited, a desired output may not be obtained.

By contrast, in the case of operation of two sets of series connection of two switching elements each, the voltage applied to the heating coil and the resonance capacitor is two times of the smoothing capacitor voltage on the basis of one end. Accordingly, the resonance current applicable to the heating coil is further increased, and the output can be set largely.

When the material to be heated is iron or other magnetic metal of high resistivity, inductive heating is realized at a high output by supplying a current of lower frequency, about 20 to 30 kHz, to the heating coil, as compared with the high-frequency current required to heat aluminum or other non-magnetic metal of low resistivity.

The control part of the invention controls and operates in the second mode, when heating iron or similar material, by conducting the first and fourth switching elements and conducting the second and third switching elements alternately, and a high output is realized.

The switching element of unipolar type is thus easy in high-frequency operation, but as compared with the switching element of bipolar type, the ON voltage is large and the ON loss may be also larger. Indeed, there is other unipolar switching element relatively lower in the ON voltage such as SiC (silicon carbide) switching element, but its material is expensive and processing is difficult, and it is more costly than the general silicon switching element. Accordingly, for the path of flow of resonance current, preferably, the number of unipolar switching elements should be as small as possible.

The four switching elements used in the invention are limited to two unipolar switching elements, and other bipolar switching elements are operated alternately when heating aluminum or similar material where high-frequency operation is not required, and a high output is obtained, and therefore it is effective to suppress undesired effects of the ON loss of the unipolar switching elements on the loss or the cost of the entire device.

A second aspect of the invention relates to an inductive heating device including a smoothing part, a series circuit of a first switching element and a second switching element connected between output ends of the smoothing part, a series circuit of a third switching element and a fourth switching element connected between the output ends, a heating coil for heating a material to be heated inductively, a resonance capacitor connected between a connection point of the first and second switching elements and a connection point of the third and fourth switching elements, for forming a resonance circuit together with the heating coil, and a control part having a second control mode for conducting the first and fourth switching elements and conducting the second and third switching elements alternately, in which a relay contact is connected in parallel to either one of the third and fourth switching elements, the first and second switching elements are of unipolar type, the third and fourth switching elements are of bipolar type, and the control part further has a first control mode for controlling and operating for conducting the first and fourth switching elements alternately in a state of conducting the relay contact and cutting off the third or fourth switching element not connected in parallel to the relay contact, and operates in the first control mode when heating the material to be heated made of aluminum, and operates in the second control mode when heating the material to be heated made of iron.

In the case of the first aspect of the invention, for example, when the control mode of conducting only the first and second switching elements alternately, the third or fourth switching element remains in conducting state. The resonance current flowing in the heating current flows into the third or fourth switching element remaining in conducting state, and the conduction loss occurs.

In the present invention, the relay contact is connected in parallel to the switching element, and instead of the first aspect in which the control part conducts the third or fourth switching element, the relay contact is kept in conducting state, and if the resonance current flows, only a conduction loss in proportion to the relay contact resistance is generated. By selecting and connecting the relay having a sufficient small contact resistance as compared with the conduction resistance of the switching element, the conduction loss can be reduced.

In addition, opening or closing of the relay may not be required to be synchronized with the driving frequency of the first and second switching elements. For example, if it will be limited only to the time of judging the material to be heated by the user after start of heating, or to the time of removal of the material to be heated, practical inconvenience may be avoid, and the number of times of opening and closing the relay may be sufficiently smaller than the number of times when opening or closing is possible. Thus risk of fusion due to aging and deterioration can be lowered.

A third aspect of the invention relates to the first or second aspect of the invention, which further includes a rectifying part, a choke coil having one end connected to an output high potential side of the rectifying part, a diode having an anode connected to other end of the choke coil and having a cathode connected to a high potential side of the smoothing part, and a fifth switching element connected between the anode of the diode and an output low potential side terminal of the rectifying part, in which the control part boosts the output voltage of the rectifying part by on/off control of the fifth switching element and supplies to the smoothing part, and therefore the input voltage of the inverter for generating a resonance current may be boosted, resulting that variation width of the heating output may be widened.

A fourth aspect of the invention relates to the first or second aspect of the invention, in which the first and second switching elements are composed of a wide band gap semiconductor material such as SiC (silicon carbide). In general, the switching element of silicon-made unipolar type is easy in high-frequency operation, but the ON operation is not accompanied by hole injection which has an ON voltage reducing effect, and the ON voltage is higher and the ON loss is larger as compared with the switching element of bipolar type.

By contrast, the wide band gap semiconductor material is capable of forming the semiconductor portion of the element necessary for assuring a switching element dielectric strength in a very small thickness and a high impurity concentration, and as compared with the switching element of silicon-made unipolar type, the ON voltage of the switching element is suppressed very low, and the ON loss can be reduced. However, since the wide band gap semiconductor material is very expensive, if the number of pieces to be used is increased, it is hard to realize the device at low cost.

The four switching elements used in this aspect of the invention are limited to two switching elements made of wide band gap semiconductor material, and the others are bipolar elements, and the low loss of the device is realized, while the cost elevation can be suppressed at the same time.

A fifth aspect of the invention relates to the first or second aspect of the invention and further includes a rectifying part for rectifying a commercial power source and supplying a direct-current voltage to the smoothing part, and an input current detecting part for detecting the input current of the rectifying part, in which the control part operates in a second control mode when the input current detection signal of the input current detecting part is larger than a preliminarily stored threshold value, and is changed over to a first control mode when the input current detection signal is smaller than the preliminarily stored threshold value.

Assuming the heating coil and the material to be heated to be an equivalent circuit composed of a series connection of inductance and resistance, the heating electric power of the material to be heated is determined almost by the impedance (resistance) of the material to be heated including the heating coil, and the current flowing in the heating coil, and hence once the relation of the heating coil and the material to be heated, and the heating electric power of the material to be heated are determined, the required flow of the current in the heating coil will be automatically determined. Accordingly, when it is necessary to increase the resonance current flowing in the heating coil by increasing the voltage flowing in the heating coil and the resonance capacitor, the voltage duty is suppressed by operating in the second control mode, and when not necessary to increase, the loss of the switching elements can be suppressed by decreasing the number of switching elements in the path of flow of the resonance current as far as possible.

The control part of the invention operates in the second control mode when the input current is larger than a specified value, and the voltage duty of the switching element is suppressed, and when the input current is lower than the specified value, high output is not required, and by changing over to the first control mode for conducting only the first and second switching elements of low switching loss alternately, the loss of the switching elements and the voltage duty of the switching elements can be suppressed.

A sixth aspect of the invention relates to the first or second aspect of the invention and further includes a switching element current detecting part, in which the control part operates in a second control mode when the detection signal of the switching element current detecting part is larger than a preliminarily stored threshold value, and it is changed over to a first control mode when the detection signal of the switching element current detecting part becomes smaller than the preliminarily stored threshold value.

Accordingly, when the current of the switching element is small, by switching and operating alternatively only the unipolar switching elements smaller in the on/off switching loss than the bipolar switching elements, the loss of the switching elements can be suppressed more efficiently when the current of the switching elements is smaller.

A seventh aspect of the invention relates to the first or second aspect of the invention and further includes a resonance output detecting part for detecting the magnitude of the resonance current, in which the control part operates in a second control mode when the detection signal of the resonance output detecting part is larger than a preliminarily stored threshold value, and it is changed over to a first control mode when the detection signal of the resonance output detecting part becomes smaller than the preliminarily stored threshold value.

The resonance output detecting part for detecting the magnitude of the resonance current detects the magnitude of the resonance output having a strong correlation with the magnitude of the resonance current, such as heating coil current, heating coil voltage, resonance capacitor current, resonance capacitor voltage, and others, and hence it is possible to estimate the current flowing in the switching elements, and when the current flowing in the switching elements is large and it is judged that the ON loss of the first and second switching elements will be excessive if operated in the first control mode, the second control mode can be selected for operating both the third and fourth switching elements of bipolar type alternately, so that the loss of the device can be reduced.

An eighth aspect of the invention relates to the first or second aspect of the invention and further includes a rectifying part for rectifying a commercial power source and supplying a direct-current voltage to the smoothing part, an input current detecting part for detecting an input current of the rectifying part, a switching element current detecting part for detecting a current of the first, second, third, and fourth switching elements, and a material discriminating part for discriminating the material to be heated by comparison between preliminarily stored threshold values and the magnitude of detection signal of the resonance output detecting part corresponding to the magnitude of detection signal of the input current detecting part, and between preliminarily stored threshold values and the magnitude of detection signal of the input current detecting part corresponding to the magnitude of detection signal of the switching element current detecting part, in which the control part controls to operate at least one conduction period of the first, second, third and fourth switching elements longer than one period of resonance current flowing in the heating coil when the material discriminating part judges the material to be heated to be aluminum.

The control part of this aspect of the invention judges the material to be heated, and when the material to heated is aluminum of non-magnetic metal of low resistivity, it supplies a sufficient resonance current of very high frequency capable of obtaining a sufficient heating capacity, for example, about three times of heating of iron, and is capable of suppressing the loss of switching elements by setting the driving frequency of the switching elements lower than the frequency of the resonance current.

A ninth aspect of the invention relates to the first or second aspect of the invention, which further includes a rectifying part for rectifying a commercial power source and supplying a direct-current voltage to the smoothing part, an input current detecting part for detecting an input current of the rectifying part, a resonance output detecting part for detecting the magnitude of a resonance current, and a material discriminating part for discriminating the material to be heated by comparison between preliminarily threshold stored values and the magnitude of detection signal of the resonance output detecting part corresponding to the magnitude of detection signal of the input current detecting part, and between preliminarily threshold stored values and the magnitude of input current detection signal of the input current detecting part corresponding to between the magnitude of detection signal of the resonance output detecting part, in which the control part controls to operate at least one conduction period of the first, second, third and fourth switching elements longer than one period of resonance current flowing in the heating coil when the material discriminating part judges the material to be heated to be aluminum.

In this aspect of the invention, the same effects as in the eighth aspect of the invention will be obtained.

A tenth aspect of the invention relates to the first or second aspect of the invention, which further includes a rectifying part for rectifying a commercial power source and supplying a direct-current voltage to the smoothing part, an input current detecting part for detecting an input current of the rectifying part, a switching element current detecting part for detecting an electric current of the first, second, third or fourth switching element, a material discriminating part for discriminating the material to be heated by comparison between preliminarily threshold stored values and the magnitude of detection signal of the switching element current detecting part corresponding to the magnitude of detection signal of the input current detecting part, and between preliminarily threshold stored values and the magnitude of detection signal of the input current detecting part corresponding to the magnitude of detection signal of the switching element current detecting part, and a changeover part for changing over the capacity of the resonance capacitor, in which the control part controls to operate the changeover part so as to increase the capacity of the resonance capacity when the material discriminating part judges the material to be heated to be iron, more than when the material discriminating part judges the material to be heated to be aluminum.

As the material to be heated, between aluminum or other non-magnetic metal of low resistivity, and iron or other magnetic metal of high resistivity, the characteristics are different, that is, the impedance in the frequency range of resonance current is very different, heating may not be always satisfactory by using the same heating coil or same resonance capacitor. That is, the impedance (resistance) of the material to be heated including the heating coil is too low, and Joule heat is hardly generated, and a large resonance current may be needed in order to obtain a high output, or if the impedance is too high, an inductive current of a proper magnitude may not be supplied.

The control part of this aspect of the invention controls so as to select the capacity of the resonance capacitor depending on the material to be heated, and it is possible to expand the heating range of inductive heating by a necessary output while suppressing the voltage duty applied to the switching elements.

An eleventh aspect of the invention relates to the first or second aspect of the invention, which further includes a rectifying part for rectifying a commercial power source and supplying a direct-current voltage to the smoothing part, an input current detecting part for detecting an input current of the rectifying part, a resonance output detecting part for detecting the magnitude of a resonance current, a material discriminating part for discriminating the material to be heated by comparison between preliminarily threshold stored values and the magnitude of detection signal of the resonance output detecting part corresponding to the magnitude of detection signal of the input current detecting part, and between preliminarily threshold stored values and the magnitude of detection signal of the input current detecting part corresponding to the magnitude of detection signal of the resonance output detecting part, and a changeover part for changing over the capacity of the resonance capacitor, in which the control part controls to operate the changeover part so as to increase the capacity of the resonance capacity when the material discriminating part judges the material to be heated to be a metal of high resistivity, more than when the material discriminating part judges the material to be heated to be aluminum.

In this aspect of the invention, the same effects as in the tenth aspect of the invention will be obtained.

Hereinafter, preferred embodiments of the present invention are specifically described below while referring to the accompanying drawings. It must be noted, however, that the invention is not limited by these preferred embodiments alone.

(Preferred Embodiment 1)

FIG. 1 is a schematic circuit diagram of an inductive heating device in preferred embodiment 1 of the present invention.

In FIG. 1, between output side terminals of a rectifying part 102 composed of a diode bridge for rectifying an alternating-current from a commercial alternating-current power source 101, a choke coil 103 and a fifth switching element 104 are connected in series. Further, at a connection point of the choke coil 103 and the fifth switching element 104, an anode side of a diode 105 is connected.

Between a cathode side of the diode 105 and an output low potential side terminal of the rectifying part 102, a smoothing part 106 composed of an electronic capacitor, a series connection body of a first switching element 107 and a second switching element 108, and a series connection body of a third switching element 109 and a fourth switching element 110 are connected in parallel.

The first switching element 107, the second switching element 108, and the fifth switching element 104 are unipolar type SiC-made MOS-FETs having characteristics not to generate tail current when turning off. The SiC is silicon carbide, and it is a wide band gap semiconductor material, and it has excellent features as the switching element, such as low loss when switching, and low turn-on voltage. As other wide band gap semiconductor material, GaN or gallium nitride or diamond may be used.

The third switching element 109 and the fourth switching element 110 are bipolar type silicon-made IGBTs having characteristics of lowering of the ON voltage when turning on, and a reverse-conductive diode is included inside. In the meantime, the first switching element 107, the second switching element 108, and the fifth switching element 104 have structurally reverse-conductive diodes formed inside, but a reverse-conducive diode may be additionally provided.

The smoothing part 106 operates to serve as a direct-current power source for an inverter 111 to be described below, and it is composed of an electrolytic capacitor of a sufficiently large capacity so as to suppress voltage fluctuations as far as possible, and in this preferred embodiment, four electrolytic capacitors of 560 μF each are used.

A heating coil 112 and a resonance capacitor 113 are connected in series at a connection point of the first switching element 107 and the second switching element 108, and a connection point of the third switching element 109 and the fourth switching element 110.

In the upper part of the heating coil 112, as an insulator, a top plate (not shown) of heat-resistant ceramics is provided, and a material to be heated 114 is placed on the top plate, oppositely to the heating coil 112.

The heating coil 112 is formed of multiple layers of twisted wires formed of bundled strand wires, wound in a flat plate, and is formed in a nearly doughnut shape of 80 mm in inside diameter, and 180 mm in outside diameter.

The resonance capacitor 113 is formed of a plurality of capacitors 113*a*, 113*b*, 113*c*, 113*d*, and 113*e*, and more specifically it is composed of a series connection body of a parallel connection body of the capacitors 113*a* and 113*b*, and a parallel connection body of the capacitors 113*c* and 113*d*, and a series connection body of a changeover part 115 of a relay contact and the capacitor 113*e* connected in parallel to this series connection body.

The capacitors 113*a*, 113*b*, 113*c*, and 113*d* respectively have a capacity of 0.02 μF, and the capacitor 113*e* is selected to have a capacity of 0.2 μF. Therefore, while the changeover part 115 is released, the composite capacity of the resonance capacitor 113 is 0.02 μF, and when short-circuited, it is 0.22 μF.

The inverter 111 includes the first switching element 107, the second switching element 108, the third switching element 109, the fourth switching element 110, the heating coil 112, the resonance capacitor 113, and the changeover part 115.

Reference numeral 116 is a control part, and it controls conduction and cut-off of the first switching element 107, the second switching element 108, the third switching element 109, and the fourth switching element 110, on the basis of detection signals from the various detecting pats, and operations by the user, and thereby controls the output of the inverter 111. That is, the control part 116 controls to vary the magnitude of the resonance current to be supplied to a resonance circuit 130, either in a first control mode for controlling and operating to conduct the first switching element 107 and the second switching element 108 alternately in a state of conducting either one of the third switching element 109 and the fourth switching element 110 while cutting off the other, or in a second control mode for conducting the first switching element 107 and the fourth switching element 110 and conducting the second switching element 108 and the third switching element 109 alternately.

The control part 116 incorporates a material discriminating part 117 in its inside, and discriminates the material of the material to be heated 114 by detection signals from the various detecting parts.

An input current detecting part 118 is composed of a current transformer, and detects an input current of the rectifying part 102 for rectifying the commercial power source 101. The detection signal of the input current detecting part 118 is connected so as to be issued to the control part 116.

A current transformer 119 for detecting an electric current of the heating coil 112 is a resonance output detecting part for detecting the magnitude of a resonance current generated by a resonance operation of the heating coil 112 and the resonance capacitor 113. A resonance output detecting part 119 detects the magnitude of the electric current of the heating coil 112 in proportion to the magnitude of the output of the inverter 111, and issues a detection signal of a magnitude in proportion to the magnitude of the heating coil 112 to the control part 116.

A second control part 120 for driving and controlling the fifth switching element 104 detects the voltage across the smoothing part 106, the input current, and others (not shown), and controls the driving frequency and the conduction ratio of the fifth switching element 104 so that the input current may be nearly a sinusoidal wave, and that the voltage of the smoothing part 106 may be a specified value.

In the inductive heating device having such configuration, the operation and the actions are explained below.

First of all, the control part 116 issues a control signal according to the manipulation by the user so that the first switching element 107 and the second switching element 108 may conduct exclusively, and that the third switching element 109 may be cut off and the fourth switching element 110 may remain in conducting state, and receives detection signals from the input current detecting part 118 and the resonance output detecting part 119.

Figure 2:
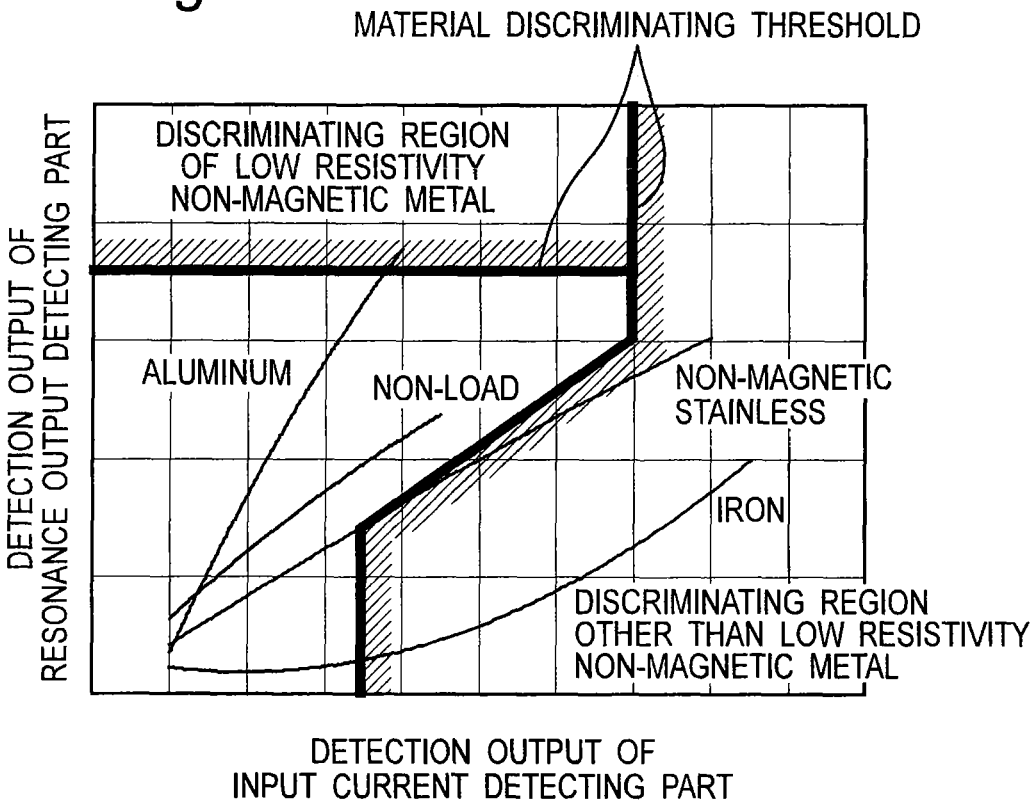
FIG. 2 is a diagram showing a material discriminating region of a material to be heated 114 in the relation of detection output of an input current detecting part 118 and detection output of a resonance output detecting part 119 held inside of a control part 116 and a material discriminating part 117 of the inductive heating device in preferred embodiment 1 of the present invention.

FIG. 2 is a diagram showing a material discriminating region of the material to be heated 114 in the relation of detection output of the input current detecting part 118 and detection output of the resonance output detecting part 119 held inside of the control part 116 and the material discriminating part 117. As shown in the diagram, the material discriminating part 117 discriminates the material of the material to be heated 114 by comparing between the preliminarily determined threshold values and the magnitude of detection signal of the input current detecting part 118 corresponding to the magnitude of detection signal of the resonance output detecting part 119, and between the preliminarily determined threshold values and the magnitude of detection signal of the resonance output detecting part 119 corresponding to the magnitude of detection signal of the input current detecting part 118.

By driving of the first switching element 107 and the second switching element 108, when the input current and the resonance output are changed, and are set in a low resistivity non-magnetic metal region of aluminum or copper as set in an upper part in FIG. 2, the control part 116 is transferred to a first control mode, and controls the output of the inverter 111 so as to cut off the third switching element, and to continue to drive the first switching element 107 and the second switching element 108 alternately while the fourth switching element 110 is kept in conducting state, so as to obtain a desired input power.

At the same time, the control part 116 and the material discriminating part 117 have discriminated the material to be heated 114 to be a non-magnetic material of low resistivity on the basis of the output signals from the input current detecting part 118 and the resonance output detecting part 119, and thereby control to open the relay contact of the changeover part 115 so that the composite capacity of the resonance capacitor 113 may be smaller.

The composite capacity of the resonance capacitor 113 is selected to be 0.02 μF when the contact point of the changeover part 115 is released, and when the material to be heated 114 is placed, the inductance of the heating coil 112 is designed to be about 160 μH, and hence the resonance frequency of the resonance capacitor 113 and the material to be heated 114 is about 90 kHz.

Figure 3:
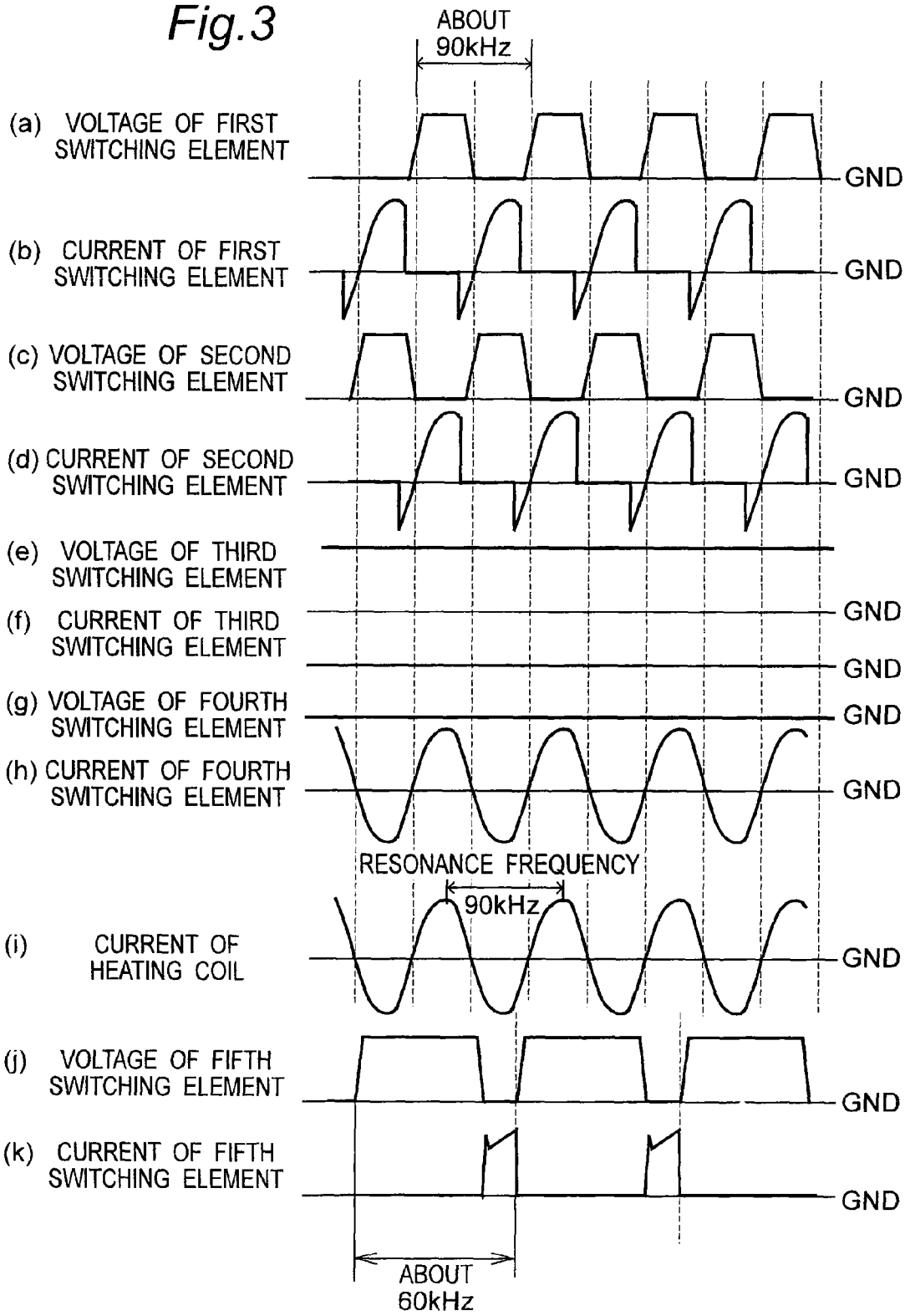
FIG. 3 is a diagram showing voltage-current waveforms of parts during inductive heating of the material to be heated 114 of non-magnetic metal of low resistivity of the inductive heating device in preferred embodiment 1 of the present invention.

FIG. 3 is a diagram showing voltage-current waveforms of parts during inductive heating of the material to be heated 114 of non-magnetic metal of low resistivity. Herein, an example of input power of 2 kW is shown.

By controlling of the control part 116 in the first control mode, the first switching element 107 and the second switching element 108 are exclusively conducted/cut off, and the inverter 111 supplies the resonance current of resonance frequency determined by the heating coil 112, the resonance capacitor 113, and the material to be heated 114, to the heating coil 112.

The heating coil 112 generates a high-frequency magnetic field, and heats the material to be heated 114 inductively. At the same time, the control part 116 controls so that the driving frequency of the first switching element 107 and the second switching element 108 may be nearly equal to the resonance current frequency.

Hereinafter, while showing a flowing route of the resonance current, an approximate operation of the inverter 111 is explained when the control part 116 is transferred to the first control mode.

In the first place, the first switching element 107 conducts (the third switching element 109 is cut off and the four switching element 110 remains in conducting state), and a voltage of the smoothing part 106 is applied at the both ends of the resonance circuit 130 formed of the heating coil 112 and the resonance capacitor 113. In this period, an electric energy is supplied to the resonance circuit 130. The resonance current flows in the direction of smoothing part 106->first switching element 107->heating coil 112->resonance capacitor 113->(fourth switching element 110)->smoothing part 106.

Next, the second switching element 107 conducts (the third switching element 109 is cut off and the four switching element 110 remains in conducting state), and a closed loop is composed of the second switching element 108, the heating coil 112, and the resonance capacitor 113, (and fourth switching element 110). In the heating coil 112 and the resonance capacitor 113, a resonance current flows on the basis of the electric energy being supplied in the conducting period of the heating coil 112 and the resonance capacitor 113.

The resonance current flows in the direction of second switching element 108->(fourth switching element 110 and built-in reverse conductive diode)->resonance capacitor 113->heating coil 112.

The fourth switching element 110 is controlled to remain in conducting state, and the voltage of the fourth switching element 110 remains nearly at zero, and the current of the fourth switching element 110 is same as the current of the heating coil 112.

The third switching element 109 is controlled to remain in cut-off state, and the voltage of the third switching element 109 is same as that of the smoothing capacitor 106, and the current remains at zero.

In this manner, the control part 116 repeats alternate conduction of the first switching element 107 and the second switching element 108, and controls while keeping the third switching element 109 in cut-off state, and the fourth switching element 110 in conducting state, and can transfer to the first control mode of inductive heating by supplying a resonance current to the heating coil 112.

Figure 4:
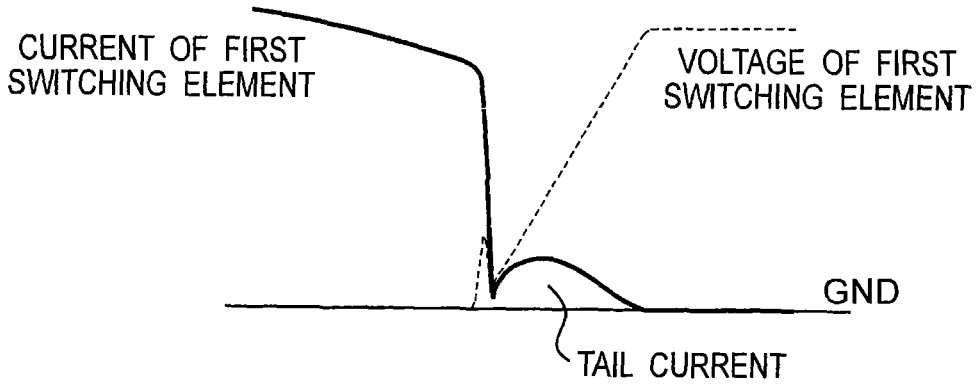
FIG. 4 is a magnified waveform diagram when turning off a first switching element of the inductive heating device in preferred embodiment 1 of the present invention.
Figure 4:
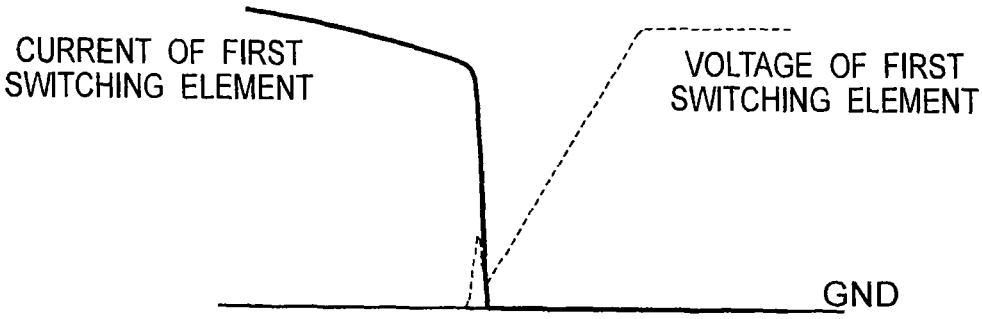

FIG. 4 is a magnified waveform diagram when turning off the first switching element 107 showing changes in the current and voltage with the passing of the time. FIG. 4(*a*) shows the first switching element 107 of bipolar type of IGBT, and FIG. 4(*b*) shows the first switching element 107 of unipolar type of MOS-FET.

In the bipolar type IGBT, a hole is injected from the gate into the semiconductor inside when turning on, and is bonded with an electron, so that the current flows easily, and it is effective to lower the ON voltage. However, when turning off, the IGBT voltage elevates and the hole remaining inside flows out with a delay, and a tail current flows as shown in FIG. 4(*a*). By this tail current, the loss is increased when turning off. In particular, this effect is notable when the driving frequency is high.

On the other hand, in the unipolar type MOS-FET, since only an electron is used when passing a current, tail current is not generated when turning off unlike the IGBT. Therefore, as shown in FIG. 4(*b*), it is close to an ideal switch state free from transient phenomenon, and the turn-off loss is very small, and it is a power device most suited to high-frequency driving.

In the preferred embodiment, when heating the material to be heated 114 of non-magnetic metal of low resistivity, the resonance current frequency is 90 kHz, and the driving frequency of the first switching element 107 and the second switching element 108 is also about 90 kHz. However, since the first switching element 107 and the second switching element 108 are unipolar type MOS-FETs free from tail current, the turn-off loss is very small, and the loss of the device can be suppressed.

Moreover, in the preferred embodiment, the first switching element 107 and the second switching element 108 are made of SiC, which is a wide band gap semiconductor material. As compared with silicon, SiC is higher in the dielectric breakdown electric field by ten times, and the thickness of the semiconductor portion of the device necessary for assuring the switching element dielectric strength can be reduced to 1/10. Besides, the impurity concentration can be 100 times, and therefore when the SiC switching element and silicon switching element of same structure are composed, ideally, the switching element resistance (ON voltage) can be suppressed to 1/1000.

Therefore, the ON voltage of the first switching element 107 and the second switching element 108 can be suppressed very low, and the ON loss can be reduced.

In the meantime, when the material to be heated 114 is a non-magnetic metal of low resistivity, in the high-frequency magnetic field generated from the heating coil 112, an eddy current is induced in the inside of the material to be heated 114. This eddy current interacts with the high-frequency magnetic field from the heating coil 112, and acts so that the material to be heated 114 may repulse against the heating coil 112, and moreover since the magnitude of the peak value fluctuates periodically in response to the ripple of the smoothing part 106, and the material to be heated 114 itself vibrates.

When the voltage of the smoothing part 106 as a direct-current power source to be applied to the inverter 111 has a ripple fluctuating in synchronism with the voltage of the commercial alternating-current power source 101, the material to be heated 114 also vibrates in synchronism, and a pan noise not comfortable for the user is generated. In the preferred embodiment, the capacity of the smoothing part 106 is sufficiently large, and fluctuations of the power source of the inverter 111 are suppressed, and generation of pan noise is suppressed.

On the other hand, however, when the capacity of the smoothing part 106 is large, the input current from the commercial alternating-current power source 101 is distorted, and the waveform is far from the original sinusoidal wave, and the power factor decreased. Since this input current contains higher harmonic components, adverse effects may be given to other devices connected to the same commercial alternating-current power source 101.

In the preferred embodiment, the choke coil 103, the fifth switching element 104, and the diode 105 have a boosting part 121 acting also as a power factor improving part. The control part 116 starts operation of the inverter 111 according to the manipulation by the user, and issues an operation start signal to the second control part 120.

The second control part 120 detects the voltage, input current and others of the smoothing part 106 (not shown), and controls the driving frequency and the conduction ratio of the fifth switching element 104 so that the input current may be nearly sinusoidal wave, and that the voltage of the smoothing part 106 may be a desired value.

When the fifth switching element 104 conducts, the short-circuit current of the choke coil 103 flows, and energy is accumulated in the choke coil 103. When the fifth switching element 104 is cut off, the energy accumulated in the choke coil 103 flows through the diode 105, and is sent into the smoothing part 106, thereby boosting the voltage.

The second control part 120 holds a reference voltage in its inside, and compares with the voltage detection signal of the smoothing part 106, and controls to be the same value, but at the same time the control part 116 changes over the voltage application or division resistance for changing the reference voltage in order to correct the voltage detection signal of the smoothing part 106, and ultimately the voltage of the smoothing part 106 is controlled by the control part 116.

The control part 116 operates the voltage detection signal of the smoothing part 106 depending on the output signals from the input current detecting part 118 and the resonance output detecting part 119, and indirectly controls the boosting amount of the boosting pat 121, and thereby changes the voltage of the smoothing part 106.

When the material to be heated 114 is a non-magnetic metal of low resistivity, the frequency region capable of continuing resonance of the heating coil 112 and the resonance capacitor 113 is very narrow, and control of output of the inverter 111 is very difficult.

However, since the smoothing part 106 is also operating as the power source for the inverter 111, by changing the voltage of the smoothing part 106, too, the output of the inverter 111 can be controlled.

Next is explained the second control mode, in which the control part 116 is transferred when the control part 116 and the material discriminating part 117 judge that the material to be heated 114 is an iron or other metal material of high resistivity.

When the inverter 111 is started to operate by the control part 116, and the control part 116 and the material discriminating part 117 judge that the material to be heated 114 is a metal of high resistivity, other than non-magnetic metal of low resistivity, on the basis of the material discriminating region of the material to be heated 114 in the relation of the detection output of the input current detecting part 118 and the detection output of the resonance output detecting part 119 as shown in FIG. 2, the control part 116 stops the operation of the inverter 111 temporarily (about 2 seconds), and controls to short-circuit the output of the changeover part 115 so that the composite capacity of the resonance capacitor 113 may be larger.

In the preferred embodiment, as mentioned above, the composite capacity of the resonance capacitor 113 is set at 0.22 μF.

After completion of changeover of the changeover part 115, the control part 116 starts operation of the inverter 111 again. At this time, the control part 116 is transferred to the second control mode, for not only controlling alternate conduction of the first switching element 107 and the second switching element 108, but also starting alternate conduction of the third switching element 109 and the fourth switching element 110 in accordance with its operation.

Figure 5:
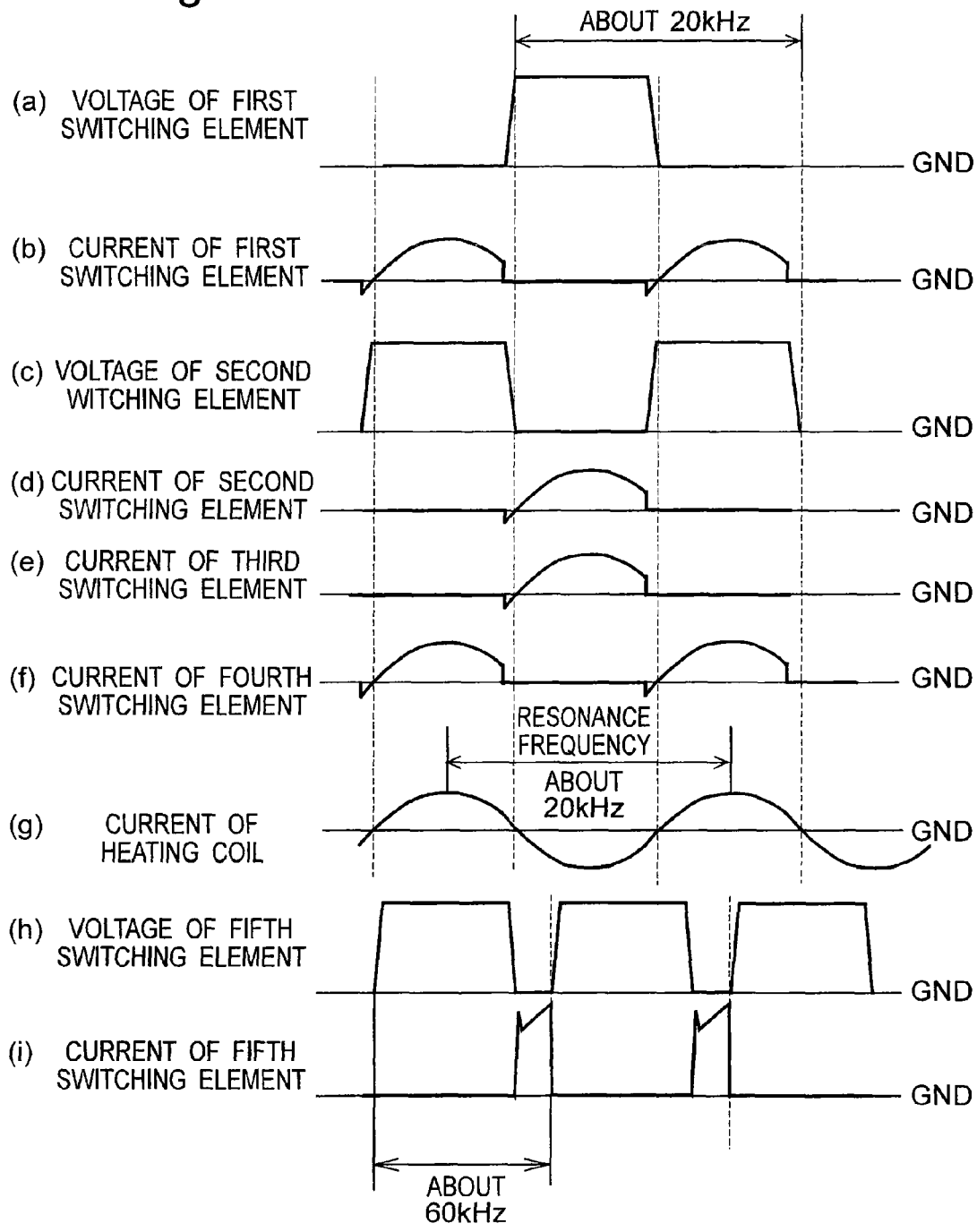
FIG. 5 is a diagram showing voltage-current waveforms of parts during inductive heating of the material to be heated 114 of other than non-magnetic metal of low resistivity of the inductive heating device in preferred embodiment 1 of the present invention.

FIG. 5 is a diagram showing voltage-current waveforms of parts during inductive heating of the material to be heated 114 such as iron or other metal of high resistivity. Approximately, the waveforms are similar to waveforms of parts when heating a non-magnetic metal of low resistivity, but what is most different lies in the resonance current frequency, and the number of switching elements to be driven. This example shows that the input power is 3 kW.

Hereinafter, while showing the flowing path of resonance current, an outline of operation of the inverter 111 is explained when the control part 116 is transferred to the second control mode.

In the first place, the first switching element 107 and the fourth switching element 110 come to conduct, and a voltage of the smoothing part 106 is applied to both ends of the resonance circuit 130 composed of the heating coil 112 and the resonance capacitor 113. In this period, an electric energy is supplied to the resonance circuit 130. The resonance current flows in the direction of smoothing part 106->first switching element 107->heating coil 112->resonance capacitor 113->fourth switching element 110->smoothing part 106.

Next, the second switching element 108 and the third switching element 109 conduct, and a voltage of the smoothing current 106 is applied reversely between the heating coil 112 and the resonance capacitor 113. In this period, too, an electric energy is supplied to the resonance circuit 130.

The resonance current flows in the direction of smoothing part 106→third switching element 109->resonance capacitor 113->heating coil 112->second switching element 108->smoothing part 106.

In this manner, the control part 116 repeats conduction of the first switching element 107 and the fourth switching element 110, and conduction of the second switching element 108 and the third switching element 109 exclusively and alternately, and thereby inductive heating is realized by supply of resonance current to the heating coil 112.

When heating iron or other metal of high resistivity as the material to be heated 114, since the resistance of the material to be heated 114 itself is high, if the magnetic field frequency is high, sufficient resonance current cannot be applied. Therefore, the control part 116, firstly, changes over so as to increase the capacity of the resonance capacitor 113, and sets the resonance frequency of the heating coil 112, the resonance capacitor 113, and the material to be heated 114 at low level (about 20 kHz in the preferred embodiment), so that the resistance of the material to be heated 114 may be low as seen from the heating coil 112.

Secondly, the control part 116 drives to operate not only the alternate conduction of the first switching element 107 and the second switching element 108 in the first control mode, but also the conduction of the first switching element 107 and the fourth switching element 110, and the conduction of the second switching element 108 and the third switching element 109 alternately, and therefore as compared with the case of driving of the first switching element 107 and the second switching element 108 only, the voltage applied to the resonance circuit 130 is doubled. Therefore, if the material to be heated 114 is high in resistance, a sufficient resonance current can be applied.

Herein, since the third switching element 109 and the fourth switching element 110 are bipolar type IGBTs, high-frequency driving as in unipolar type switching element is difficult, but as compared with the first control mode, the resonance frequency is lower, and if the driving frequency of the switching element is nearly same as the resonance frequency, increase of turn-off loss can be suppressed within an allowable range. In addition, since the resistance of the material to be heated 114 is high, the Joule heat increases, and the required high-frequency resonance current is smaller, and the turn-off loss and the conduction ON loss can be also suppressed low.

Moreover, the choke coil 103, the fifth switching element 104, and the diode 105 have the boosting part 121 operating also as the power factor improving part, and the output voltage (the voltage of the smoothing capacitor 106) can be controlled by the control part 116 and the second control part 120.

By changing the relay contact of the changeover part 115 from open to closed state, the resonance current frequency can be lowered in frequency by largely changing over the capacity of the resonance capacitor 113. In addition to this operation, only by transferring the mode from the first control mode to the second control mode of all switching elements contained in the inverter 111, if a required output is not obtained, the output may be assured easily by controlling to elevate the voltage of the smoothing capacitor 106 by the boosting part 121.

Although not particularly shown in the drawings, when the output setting is low, or the material to be heated 114 is a steel plate or other metal likely to be heated by a small current, it is not necessary to drive all switching elements. When the control part 116 detects that the detection signal of the input current detecting part 118 or the resonance current detecting part 119 is more than a preliminarily stored threshold value, and judges that the heating output is more than a specified level, it operates in the second control mode, or when it detects that the detection signal of the input current detecting part 118 or the detection signal of the resonance current detecting part 119 is smaller than the preliminarily stored threshold value, and judges that the heating output is smaller than the specified level, it is transferred to the first control mode, and hence as compared with case of the heating output lower than the specified level, the number of the switching elements contained in the current path can be decreased as compared with the case of the higher level, so that the loss of the device can be reduced.

When the control part 116 and the material discriminating part 117 judge that the material to be heated 114 is a non-magnetic metal of low resistivity, and that the output setting by the user is high, the operation is explained below.

By driving the first switching element 107 and the second switching element 108 in the first control mode, the input current and the resonance output are changed, and in FIG. 2, the detection output of the resonance output detecting part 119 becomes larger than a specified value and the detection output of the input current detecting part 118 comes into a low-resistivity non-magnetic metal region such as aluminum being set at lower than a specified value, and when the output setting is high, the control part 116 is transferred to the second control mode while continuing to drive the first switching element 107 and the second switching element 108, and driving of the third switching element 109 and the fourth switching element 110 is also started, and the output of the inverter 111 is controlled so as to settle within a specified input power.

At the same time, the control part 116 and the material discriminating part 117 have judged the material to be heated 114 as a non-magnetic metal of low resistivity on the basis of the output signals of the input current detecting part 118 and the resonance output detecting part 119, and it is controlled to release the output of the changeover part 115 so as to lower the composite capacity of the resonance capacitor 113, and the resonance frequency of the heating coil 112, the resonance capacitor 113, and the material to be heated 114 is set to about 90 kHz.

Figure 6:
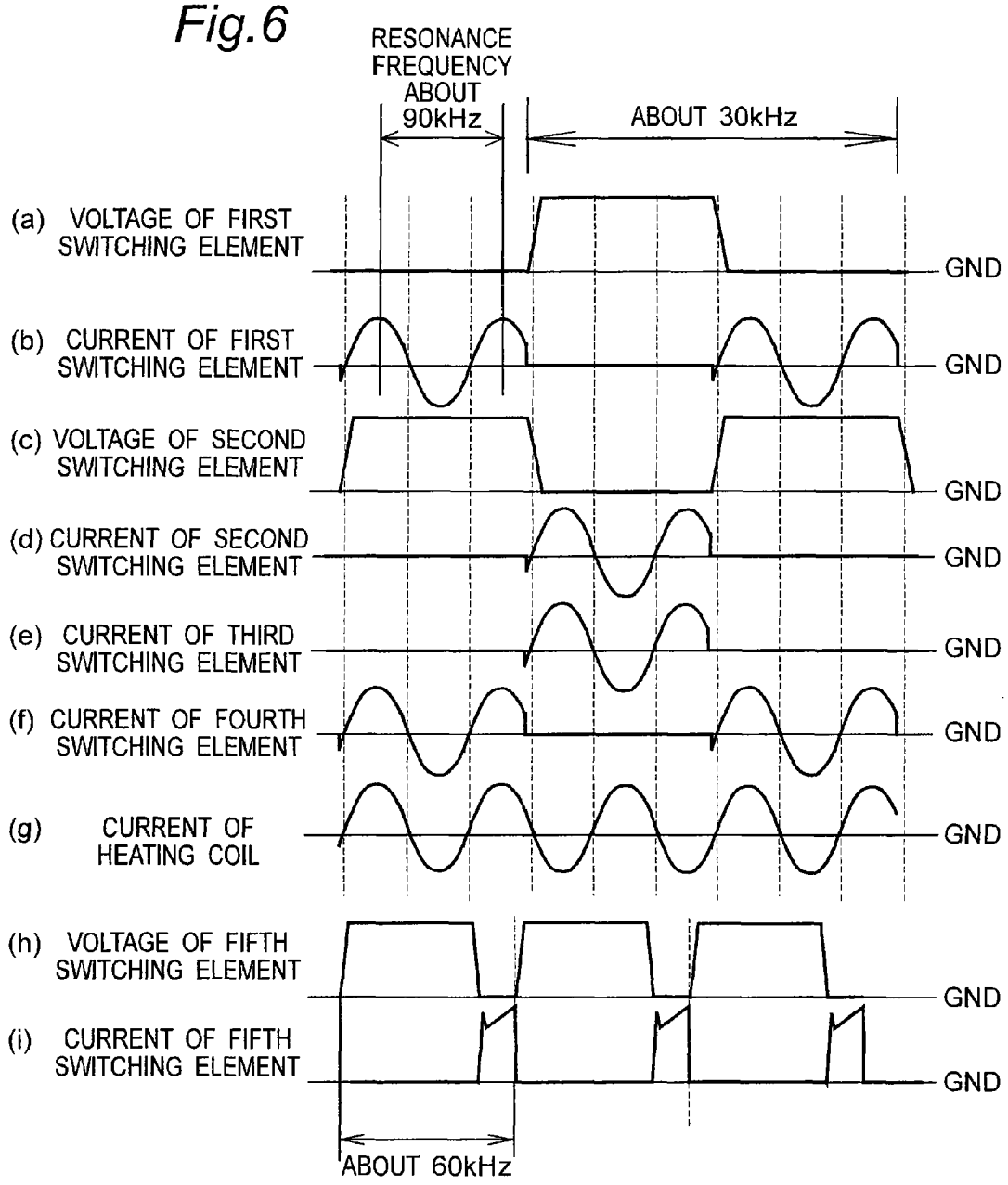
FIG. 6 is a diagram showing voltage-current waveforms of parts during inductive heating at high output of the material to be heated 114 of non-magnetic metal of low resistivity of the inductive heating device in preferred embodiment 1 of the present invention.

FIG. 6 is a diagram showing voltage-current waveforms of parts during inductive heating at high output of the material to be heated 114 of non-magnetic metal of low resistivity. Herein, this is an example of input power of 2.5 kW. Approximately, the waveforms are similar to the waveforms of the parts when heating the non-magnetic metal of low resistivity at 2 kW, and the waveforms of the parts when heating the metal of high resistivity at 3 kW, but what is particularly different lies in the waveform of the current flowing in the switching elements.

By controlling of the control part 116, the conduction of the first switching element 107 and the fourth switching element 110, and the conduction of the second switching element 108 and the third switching element 109 are carried out alternately, and the inverter 111 supplies the resonance current having a resonance frequency determined by the heating coil 112, the resonance capacitor 113, and the material to be heated 114 to the heating coil 112. The heating coil 112 generates a high-frequency magnetic field, and heats the material to be heated 114.

As shown in FIG. 6, the control part 116 is controlling the conduction period so that the resonance current may flow for about 1.5 periods during conduction period of the first switching element 107 and the fourth switching element 110, and during conduction period of the second switching element 108 and the third switching element 109, and that the each conducting period may be nearly equal.

Hereinafter, while showing the flowing path of resonance current, the operation of the inverter 111 is explained when the control part 116 is transferred to the second control mode.

In the first place, the first switching element 107 and the fourth switching element 110 come to conduct, and a voltage of the smoothing part 106 is applied to both ends of the resonance circuit 130. In this period, an electric energy is supplied to the both ends of the resonance circuit 130.

In the conduction period of the first switching element 107 and the fourth switching element 110, it is set so that the resonance current may flow for about 1.5 periods, and the current also flows into a parasitic diode included in the internal structure of the first switching element 107, or a reverse conductive diode incorporated in the fourth switching element 110.

In other words, the resonance current flows to circulate through the smoothing part 106, the first switching element 107, the heating coil 112, the resonance capacitor 113, the fourth switching element 110, and the smoothing part 106.

Next, the second switching element 108 and the third switching element 109 conduct, and a voltage of the smoothing part 106 is applied reversely between the heating coil 112 and the resonance capacitor 113. Also in this period, an electric energy is supplied to the heating coil 112 and the resonance capacitor 113.

In the conduction period of the second switching element 108 and the third switching element 109, similarly, it is also set so that the resonance current may flow for about 1.5 periods, the current flows also into a parasitic diode included in the internal structure of the second switching element 108, or a reverse conductive diode incorporated in the third switching element 109. The resonance current flows to circulate through the third switching element 109, the resonance capacitor 113, the heating coil 112, the second switching element 108, and the smoothing part 106.

As explained herein, the control part 116 repeats the conduction of the first switching element 107 and the fourth switching element 110, and the conduction of the second switching element 108 and the third switching element 109 alternately, and can be transferred to the second control mode for performing inductive heating by supply of resonance current to the heating coil 112.

This operation is particularly effective when the material to be heated 114 is a non-magnetic metal of low resistivity. When the material to be heated 114 is a non-magnetic metal of low resistivity, attenuation of high-frequency resonance current is smaller because of the low resistance. Hence, the resonance continues if the driving time of the first switching element 107, the second switching element 108, the third switching element 109, and the fourth switching element 110 is set longer as compared with the resonance frequency.

Herein, the frequency of the resonance current is determined by the heating coil 112, the resonance capacitor 113, and the material to be heated 114, and it is about 90 kHz as mentioned above, and the driving frequency of the switching element is about 30 kHz in the case of this preferred embodiment. In the third switching element 109 and the fourth switching element 110 of IGBT becoming large in the turn-off loss due to tail generation, since the driving frequency is lower as compared with the resonance current frequency, it is possible to suppress the increase of turn-off loss.

By driving not only the first switching element 107 and the second switching element 108, but also the third switching element 109 and the fourth switching element 110, as compared with the case of driving only the first switching element 107 and the second switching element 108, the voltage applied to the heating coil 112 and the resonance capacitor 113 is doubled, and if the output setting is high, a required resonance current can be supplied.

As described herein, this preferred embodiment has the first control mode for conducting the first and second switching elements 107, 108 alternately, cutting off the third switching element 109, and conducting the fourth switching element 110, and the second control mode for conducting the first switching element 107 and the fourth switching element 110, and conducting the second switching element 108 and the third switching element 109 alternately. In the first control mode, the same operation can be carried out by conducting the third switching element 109 and cutting off the fourth switching element 110.

When the material to be heated 114 is aluminum or other non-magnetic metal of low resistivity, high-frequency operation of the switching elements is required, and two unipolar type switching elements of high speed operation are connected in series, and the first control mode for conducting the first and second switching elements 107, 108 alternately is selected.

When the material to be heated 114 is ion or other metal of high resistivity and a high output is required, the resonance frequency is set lower, and the second control mode is selected for conducting the third and fourth switching elements of low ON voltage alternately, by matching with the alternate conduction of the first and second switching element 107 and 108.

In particular, when high output is not required, the first control mode is selected for conducting the first and second switching elements 107 and 108 alternately.

Furthermore, when a high-frequency resonance current is required and also a high output is needed, the second control mode is selected for driving all switching elements, and the switching element conduction period is controlled longer than one period of resonance current flowing in the heating coil 112.

By selecting the control mode in such manner, the device can be lowered in loss, and the inductive heating device easy in cooling design can be presented.

In the preferred embodiment, where the output setting is low, or depending on the state of the material to be heated 114, an example of selecting the first control mode is shown, but not limited to this example, depending on the cooling condition of the switching elements, or the ratio of the turn-on loss and the turn-off loss, the second mode may be selected for cutting of either one of the first switching element 107 and the second switching element 108, conducting the other one, and conducting the third switching element 109 and the fourth switching element 110 alternately.

The changeover part 115 is a relay, but not limited to this, a semiconductor switching element or the like may be used as far as allowed from the viewpoint of the dielectric strength or the current capacity.

As the resonance output detecting part 119, an example of current transformer for detecting the current of the heating coil 112 is shown, but the voltage of the resonance capacitor 113 may be detected, or same effects may be obtained by detecting the current of the smoothing part 106 as the direct-current power source of the inverter 111.

Aside from the control part 116, the second control part 120 is provided, but the operation of the second control part 120 may be commonly executed by the control part 116.

In the above example, the control part 116 selects either the first control mode or the second control mode, by discriminating the material to be heated 114, whether aluminum or other non-magnetic metal of low resistivity or iron or other magnetic metal of high resistivity, but alternatively, for example, in spite of a non-magnetic metal, a non-magnetic stainless steel of higher resistance as compared with aluminum may be distinguished from non-magnetic metal of low resistivity or iron or other magnetic metal of higher resistance. Further, the magnetic metal may be discriminated from steel plate, or from cast iron or magnetic stainless steel of higher resistance than steel plate. Thus, the material discrimination may not be limited to two types, but may be judged in three or four types, and a necessary output of the inverter 111 may be obtained by properly combining the conduction period control of switching elements, or control of changeover part 115, and others.

In particular, pan noise is generated particularly evidently when the material to be heated is aluminum or other lightweight non-magnetic metal of low resistivity, and when the material to be heated 114 is limited to materials other than lightweight non-magnetic metals of low resistivity, the capacity of the smoothing part 106 may be lowered as required. If lowering of power factor, and higher harmonics of the input current are within an allowable range, the boosting part 121 having a power factor lowering function may not be always necessary. The configuration may be changed or modified in appropriate combinations in consideration of the cost and the effect.

In the preferred embodiment, the conduction periods of the first switching element 107 and the second switching element 108 to be conducted alternately are nearly identical, but it is not limited to this example. For example, when heating the material to be heated 114 of non-magnetic metal of low resistivity, the conduction period of the first switching element 107 may be controlled to be shorter than one period of the resonance current, so as to be similar to the current waveform when heating the material to be heated 114 other than non-magnetic metal of low resistivity, and the conduction period of the second switching element 108 may be controlled to be longer than one period of the resonance current.

Besides, when the conduction periods of the first switching element 107 and the second switching element 108 are different, it may be controlled to exchange the conduction periods. The same applies to the third switching element 109 and the fourth switching element 110.

As in this preferred embodiment, when heating the material to be heated 114 of non-magnetic metal of low resistivity, if the conduction period of the switching elements is controlled longer than one period, the duration of n periods (n being an integer of 1 or more) of the resonance current does not contribute to supply of electric power, and the ratio of the time of supply of electric power from the smoothing part 106 as the power source of the inverter 111 decreases during one period of driving of switching elements, and the heating electric power that can be applied in principle. However, by controlling the conduction period of the first switching element 107 to be shorter than one period of resonance current, and the conduction period of the second switching element 108 to be longer than one period of the resonance current (to in reverse relation), the time ratio of supply of electric power from the smoothing part 106 can be enhanced, and the heating power that can be applied can be increased in principle.

In such a case, a loss difference occurs due to the difference in conduction period of the first switching element 107 and the second switching element 108, but by controlling to exchange the conduction period of the first switching element 107 and the second switching element 108, the loss can be smoothed.

The same applies to the third switching element 109 and the fourth switching element 110.

(Preferred Embodiment 2)

Figure 7:
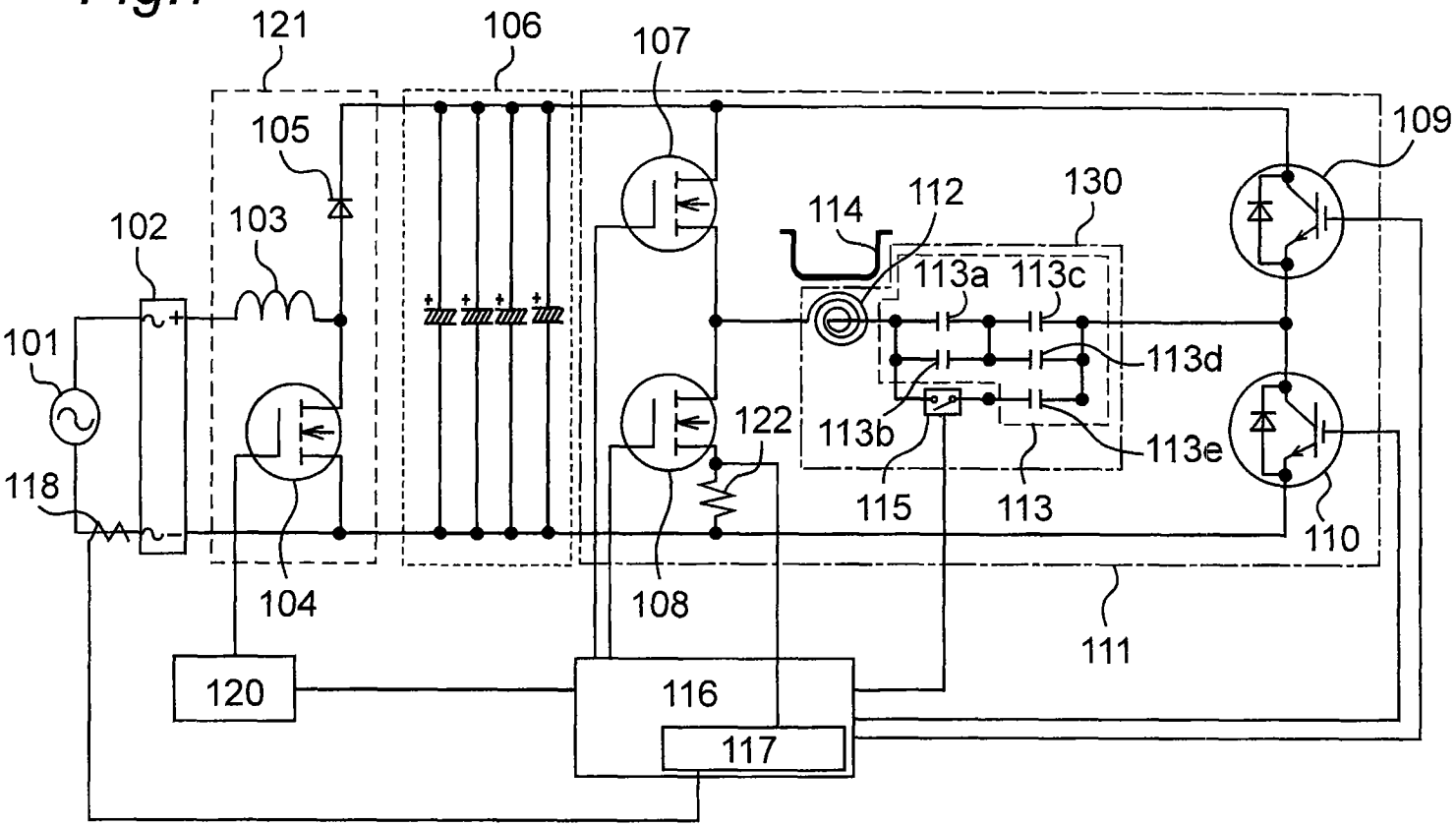
FIG. 7 is a schematic circuit diagram of an inductive heating device in preferred embodiment 2 of the present invention.

FIG. 7 is a schematic circuit diagram of an inductive heating device in preferred embodiment 2 of the present invention. The configuration is almost same as in the example of preferred embodiment 1, and only different parts are specifically described below.

In FIG. 7, the control part 116 controls conduction and cut-off of the first switching element 107, the second switching element 108, the third switching element 109, and the fourth switching element 110, on the basis of the detection signals from the various detecting parts and the manipulation by the user, and controls the output of the inverter 111.

Further, the control part 116 incorporates the material discriminating part 117 in its inside, and discriminates the quality of the material to be heated 114 from the detection signals from the detecting parts.

The input current detecting part 118 is specifically composed of a current transformer. The detection signal of the input current detecting part 118 is connected to be issued to the control part 116.

A switching element current detecting part 122 is a detecting part of a current flowing in the second switching element 108, and is composed of a shunt resistance, and detects the current flowing in the second switching element 108, and sends a detection signal to the control part 116.

In such configuration, the current flowing in the second switching element 108 is a current flowing intermittently in the heating coil 112, and from its amplitude the current of the heating coil 112 having a close relationship with the magnitude of the resonance output can be easily estimated, and the switching element current detecting part 122 may be used in place of the resonance output detecting part 119 for detecting the magnitude of the resonance current in preferred embodiment 1.

In this preferred embodiment, too, same as in preferred embodiment 1, the control part 116 has a first control mode for conducting the first switching element 107 and the second switching element 108 alternately, cutting off the third switching element 109, and keeping the fourth switching element 110 in conducting state, and a second control mode for conducting the first and fourth switching elements and the second and third switching elements alternately.

Therefore, during the driving period of the switching elements of the inverter 111, a resonance current flows at least once in the second switching element 108, and the switching element current detecting part 122 detects the current of the second switching element 108, and can detect the current of the heating coil 12 in a sufficient sampling period.

Moreover, in particular, when operated at high frequency in the first control mode, noise effect are likely to occur, and, for example, if conducting at the same time by faulty operation of the first switching element 107 and the second switching element 108, the output of the switching element detecting part 122 changes suddenly, and it can be detected, and therefore the control part 116 can immediately stop driving of all switching elements, so that breakdown of the switching elements can be prevented.

In this preferred embodiment, incidentally, the switching element current detecting part 122 is provided to detect the current of the second switching element 108, but a switching element current detecting part may be provided so as to detect the current of the first switching element 107, the third switching element 109, or the fourth switching element 110, and it may be used in place of the resonance output detecting part 119 for detecting the magnitude of the resonance current in preferred embodiment 1.

(Preferred Embodiment 3)

Figure 8:
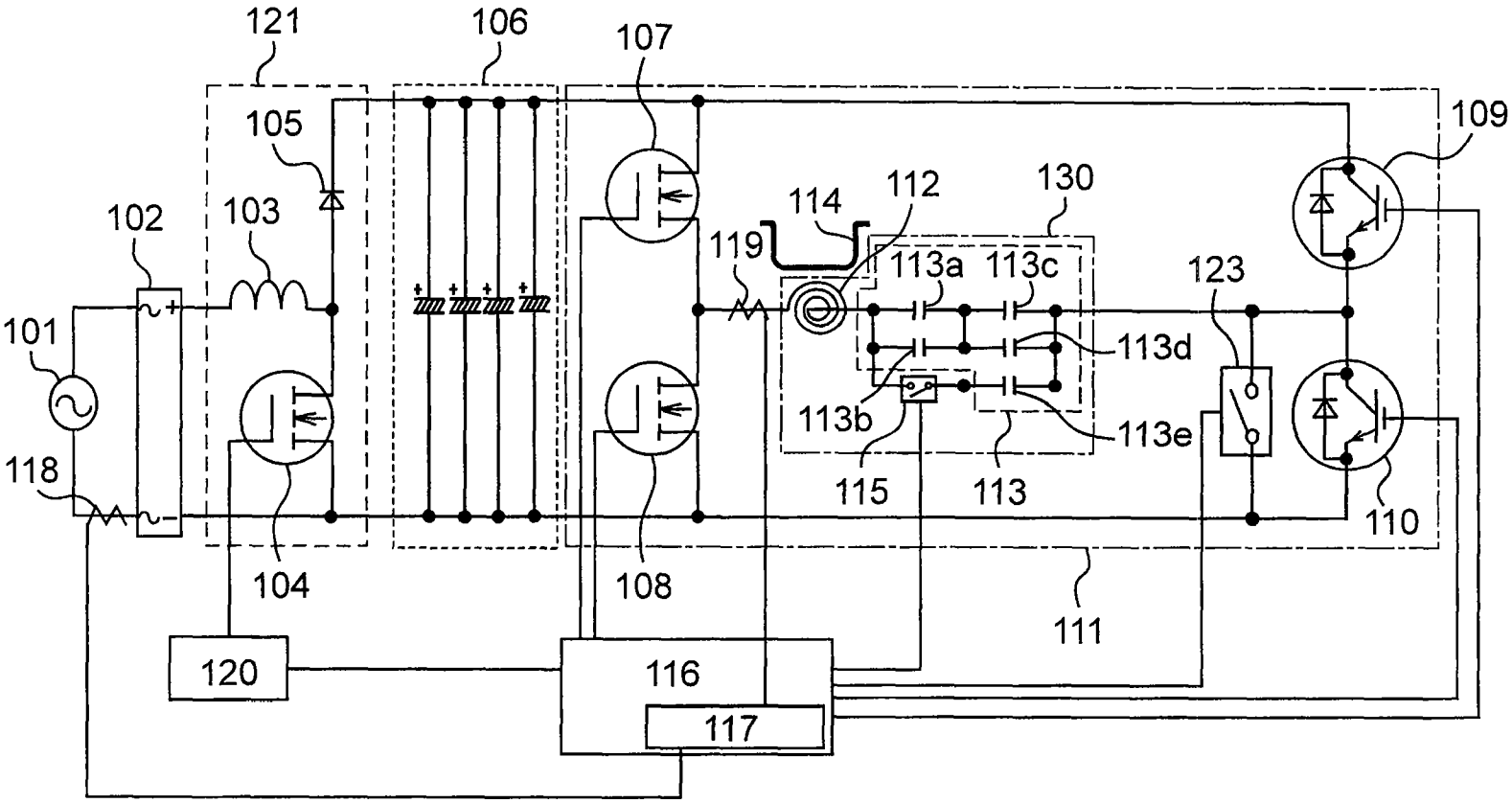
FIG. 8 is a schematic circuit diagram of an inductive heating device in preferred embodiment 3 of the present invention.
Figure 9:
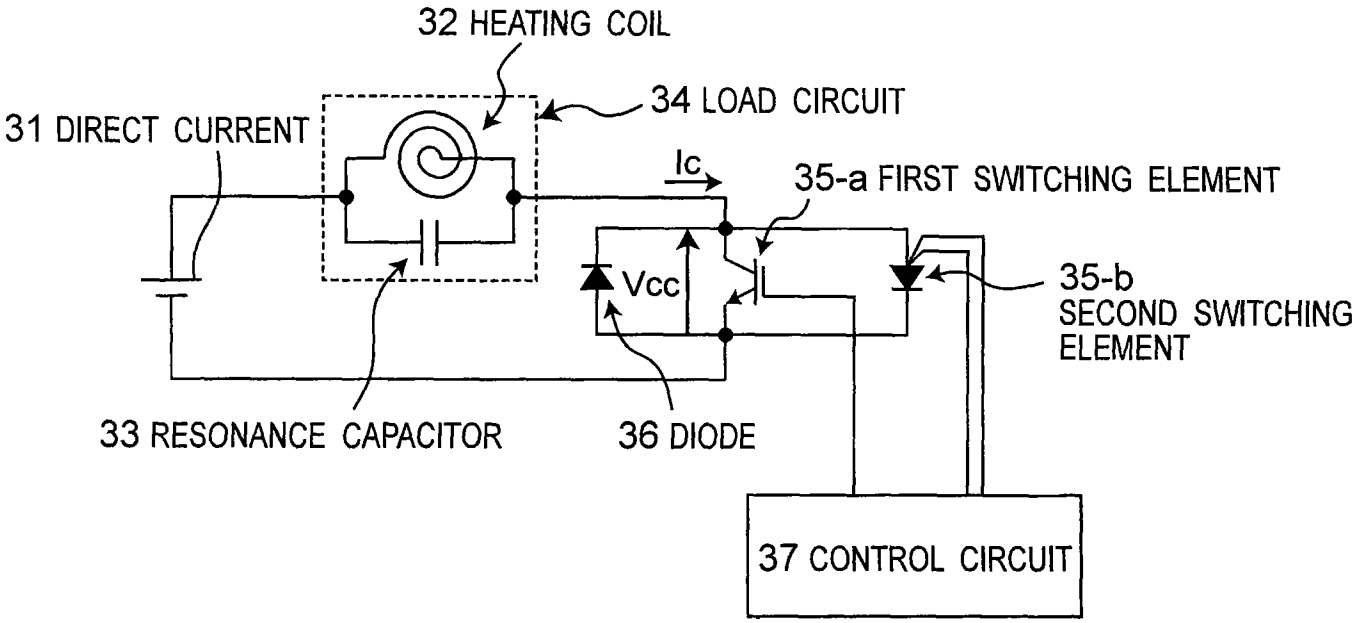
Fig.9 Prior Art
FIG. 9 is a circuit diagram of a conventional inductive cooking device.
Figure 10:
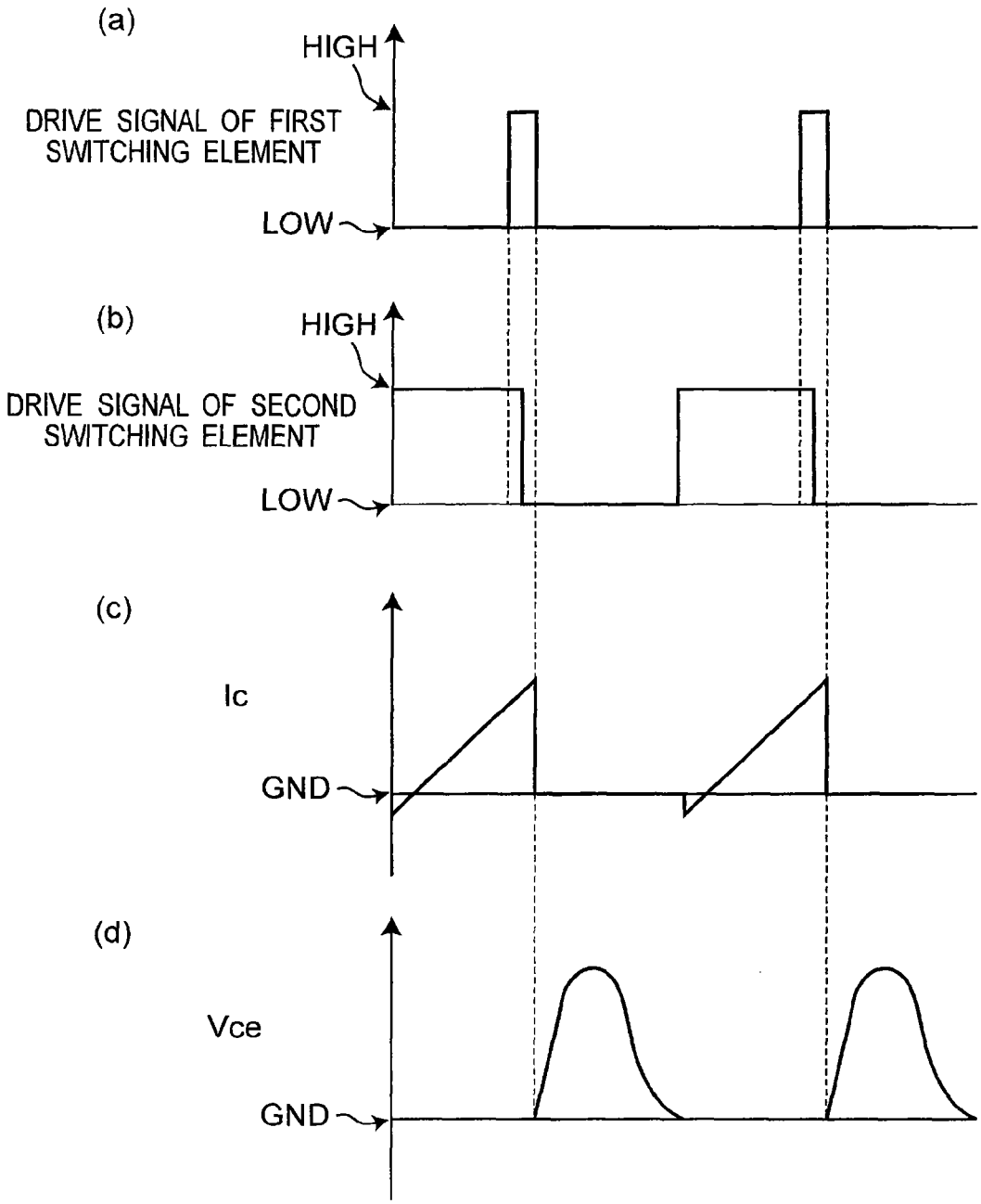
Fig.10 Prior Art
FIG. 10 is a waveform diagram showing operation of the circuits of the conventional inductive cooking device.

FIG. 8 is a schematic circuit diagram of an inductive heating device in preferred embodiment 3 of the present invention. The configuration is almost same as in FIG. 1, an example of preferred embodiment 1, and only different parts are specifically described below.

In FIG. 8, the contact point of the relay 123 is connected in parallel to the fourth switching element 110, and conduction and cut-off are controlled by a signal from the control part 116.

The control part 116 controls conduction and cut-off of the first switching element 107, the second switching element 108, the third switching element 109, and the fourth switching element 110, on the basis of the detection signals from the various detecting parts and the manipulation by the user, and controls the output of the inverter 111.

Further, the control part 116 incorporates the material discriminating part 117 in its inside, and discriminates the quality of the material to be heated 114 from the detection signals from the detecting parts.

The input current detecting part 118 is specifically composed of a current transformer. The detection signal of the input current detecting part 118 is connected to be issued to the control part 116.

The current transformer 119 which is a current detecting part of the heating coil 112 is a resonance output detecting part for detecting the magnitude of the resonance output. The resonance output detecting part 119 detects the current of the heating coil 112, which is the magnitude of the output of the inverter 111, and issues a detection signal to the control part 116.

In such configuration, the control part 116 starts heating of the material to be heated 114 on the basis of the manipulation by the user, while cutting off the contact point of the relay 123. The material discriminating part 117 discriminates the material to be heated 114, and when it is judged that it is proper to operate in a first control mode for conducting only the first switching element 107 and the second switching element 108 alternately, the control part 116 once stops driving of all switching elements, and then controls to cut off the third switching element 109, and conduct the relay 123. Afterwards, the control part 116 controls to conduct the first switching element 107 and the second switching element 108 alternately again.

In this preferred embodiment, as explained in preferred embodiment 1 by referring to FIG. 3, while the material to be heated 114, which is a non-magnetic metal of low resistivity, is being heated inductively at an input power of 2 kW, the control part 116 controls so that the driving frequency of the first switching element 107 and the second switching element 108 may be nearly same as the resonance current frequency.

Further, the third switching element 109 remains in cut-off state same as in preferred embodiment 1, but the fourth switching element 110 is also controlled to remain in cut-off state. Instead, the contact point of the relay 123 connected in parallel to the fourth switching element 110 is controlled to conduct, and the resonance current flows in the relay 123.

In the case of inductive heating of the material to be heated 114 made of non-magnetic metal of low resistivity, a large resonance current is required in order to obtain a sufficient heat generation. Therefore, as in preferred embodiment 1, if the fourth switching element 110 is kept in cut-off state, a conduction loss proportional to the product of the ON voltage and the flowing current is generated in the fourth switching element 110.

In the preferred embodiment, since the contact point of the relay 123 is conducting, a resonance current does not flow in the fourth switching element 110. When the contact point of the relay 123 of small contact resistance is selected and connected, the conduction loss occurring in the relay 123 can be sufficiently reduced. For example, in the case of a bipolar type switching element of dielectric strength of 600 V and current rating of 60 A of general use, in the case of flow of current of 30 A, the voltage across the terminals is about 1.5 V (50 mΩ as converted to resistance), and in the case of a relay, the maximum resistance is about 20 mΩ, and the conduction loss can be reduced to ½ or less.

In this preferred embodiment, instead of connecting the contact point of the relay 123 in parallel to the fourth switching element 110, it may be connected in parallel to the third switching element 109, and by operating similarly, same effects as in the above-mentioned effects may be obtained.

Industrial Applicability

As described herein, the inductive heating device of the present invention is capable of lowering the device loss, and the inductive heating device easy in cooling design can be presented, and it is applicable not only in inductive cooking device, inductive water heater, inductive heating iron, and other inductive heating applications.

The invention claimed is:

1. An inductive heating device for inductively heating a material, the device comprising:

a smoothing part having output ends;

a first series circuit comprising a first switching element and a second switching element connected between the output ends of the smoothing part;

a second series circuit comprising a third switching element and a fourth switching element connected between the output ends;

a heating coil;

a resonance circuit comprising a resonance capacitor connected between a connection point of the first and second switching elements and a connection point of the third and fourth switching elements, and the heating coil; and a control part that varies the magnitude of the resonance current in the resonance circuit, between a first mode for alternately operating the first and second switching elements in a state of conducting either one of the third and fourth switching elements and cutting off the other, and a second mode for alternately conducting the first and fourth switching elements and conducting the second and third switching elements, wherein the first and second switching elements comprise unipolar type switching elements, and the third and fourth switching elements comprise bipolar type switching elements, and the control part operates in the first mode for alternately operating the first and second switching elements in a state of conducting the fourth switching element and cutting off the third switching element upon heating a material comprising aluminum, and operates in the second mode for conducting the first and fourth switching elements and alternately conducting the second and third switching elements upon heating a material comprising iron.

2. An inductive heating device for inductively heating a material, the device comprising:

a smoothing part having output ends;

a first series circuit comprising a first switching element and a second switching element connected between the output ends of the smoothing part;

a second series circuit comprising a third switching element and a fourth switching element connected between the output ends;

a heating coil;

a resonance circuit comprising a resonance capacitor connected between a connection point of the first and second switching elements and a connection point of the third and fourth switching elements and the heating coil;

a control part including a second control mode for conducting the first and fourth switching elements and alternately conducting the second and third switching elements; and a relay contact connected in parallel to the fourth switching element, wherein the first and second switching elements comprise unipolar type switching elements, the third and fourth switching elements comprise bipolar type switching elements, and the control part further includes a first control mode for alternately operating the first and second switching elements in a state of conducting the relay contact and cutting off the third switching element not connected in parallel to the relay contact, and operates in the first control mode for alternately operating the first and second switching elements in a state of conducting the relay contact and cutting off the third switching element upon heating a material comprising aluminum, and operates in the second control mode upon heating a material comprising iron.

3. The inductive heating device according to claim 1 further comprising:

a rectifying part;

a choke coil having a first end connected to a high potential side output of the rectifying part, a diode having an anode connected to a second end of the choke coil and having a cathode connected to a high potential side of the smoothing part, and a fifth switching element connected between the anode of the diode and a low potential side output terminal of the rectifying part, wherein the control part boosts the output voltage of the rectifying part by on/off control of the fifth switching element and supplies current to the smoothing part.

4. The inductive heating device according to claim 2 further comprising:

a rectifying part;

a choke coil having a first end connected to a high potential side output of the rectifying part a diode having an anode connected to a second end of the choke coil and having a cathode connected to a high potential side of the smoothing part; and a fifth switching element connected between the anode of the diode and a low potential side output terminal of the rectifying part;

wherein the control part boosts the output voltage of the rectifying part by on/off control of the fifth switching element and supplies current to the smoothing part.

5. The inductive heating device according to claim 1, wherein the first and second switching elements comprise a wide band gap semiconductor material.

6. The inductive heating device according to claim 2, wherein the first and second switching elements comprise a wide band gap semiconductor material.

7. The inductive heating device according to claim 1, further comprising:

a rectifying part for rectifying a commercial power source and supplying a direct-current voltage to the smoothing part; and an input current detecting part for detecting an input current of the rectifying part, wherein, if an input current detection signal of the input current detecting part is larger than a preliminarily stored threshold value, the control part discriminates that the output setting is not low and, regardless of the material to be heated, operates in the second control mode, and, if the input current detection signal is smaller than the preliminarily stored threshold value, the control part discriminates that the output setting is low and, regardless of the material composition, changes over to the first control mode.

8. The inductive heating device according to claim 2, further comprising:

a rectifying part for rectifying a commercial power source and supplying a direct-current voltage to the smoothing part, and an input current detecting part for detecting the input current of the rectifying part, wherein, if an input current detection signal of the input current detecting part is larger than a preliminarily stored threshold value, the control part discriminates that the output setting is not low and, regardless of the material to be heated, operates in the second control mode, and, if the input current detection signal is smaller than the preliminarily stored threshold value, the control part discriminates that the output setting is low and, regardless of the material composition, changes over to the first control mode.

9. The inductive heating device according to claim 1, further comprising:

a switching element current detecting part for detecting a current of the first, second, third, and fourth switching elements, wherein, if a detection signal of the switching element current detecting part is larger than a preliminarily stored threshold value, the control part discriminates that the material is not a metal likely to be heated by a small current and, regardless of the material composition, operates in the second control mode, and, if the detection signal of the switching element current detecting part becomes smaller than the preliminarily stored threshold value, the control part discriminates that the material composition is a metal likely to be heated by a small current and, regardless of the material composition, changes over to the first control mode.

10. The inductive heating device according to claim 2 further comprising a switching element current detecting part for detecting a current of the first, second, third, and fourth switching elements, wherein, if a detection signal of the switching element current detecting part is larger than a preliminarily stored threshold value, the control part discriminates that the material composition is not a metal likely to be heated by a small current and, regardless of the material composition, operates in the second control mode, and, if the detection signal of the switching element current detecting part becomes smaller than the preliminarily stored threshold value, the control part discriminates that the material composition is a metal likely to be heated by a small current and, regardless of the material composition, changes over to the first control mode.

11. The inductive heating device according to claim 1 further comprising a resonance output detecting part for detecting the magnitude of the resonance current, wherein, if a detection signal of the resonance output detecting part is larger than a preliminarily stored threshold value, the control part discriminates that the material composition is not a metal likely to be heated by a small current and, regardless of the material composition, operates in the second control mode, and, if the detection signal of the resonance output detecting part becomes smaller than the preliminarily stored threshold value, the control part discriminates that the material composition is a metal likely to be heated by a small current and, regardless of the material composition, changes over to the first control mode.

12. The inductive heating device according to claim 2, further comprising: a resonance output detecting part for detecting the magnitude of the resonance current, wherein, if a detection signal of the resonance output detecting part is larger than a preliminarily stored threshold value, the control part discriminates that the material composition is not a metal likely to be heated by a small current and, regardless of the material composition, operates in the second control mode, and, if the detection signal of the resonance output detecting part becomes smaller than the preliminarily stored threshold value, the control part discriminates that the material composition is a metal likely to be heated by a small current and, regardless of the material to be heated, changes over to the first control mode.

13. The inductive heating device according to claim 1 further comprising:

a rectifying part for rectifying a commercial power source and supplying a direct-current voltage to the smoothing part;

an input current detecting part for detecting an input current of the rectifying part;

a switching element current detecting part for detecting a current of the first, second, third, and fourth switching elements, a resonance output detecting part for detecting the magnitude of the resonance current, and a material discriminating part for discriminating the material by comparison between preliminarily stored threshold values and a magnitude of a detection signal of the resonance output detecting part corresponding to a magnitude of a detection signal of the input current detecting part, and between the preliminarily stored threshold values and the magnitude of detection signal of the input current detecting part corresponding to a magnitude of detection signal of the switching element current detecting part, wherein, if the material discriminating part judges that the material composition comprises aluminum, the control part controls to operate in the first mode and to operate at least one conduction period of the first, second, third and fourth switching elements longer than one cycle of a period of resonance current flowing in the heating coil.

14. The inductive heating device according to claim 2 further comprising:

a rectifying part for rectifying a commercial power source and supplying a direct-current voltage to the smoothing part;

an input current detecting part for detecting an input current of the rectifying part;

a switching element current detecting part for detecting a current of the first, second, third, and fourth switching elements, a resonance output detecting part for detecting the magnitude of the resonance current, and a material discriminating part for discriminating the material by comparison between preliminarily stored threshold values and a magnitude of detection signal of the resonance output detecting part corresponding to a magnitude of a detection signal of the input current detecting part, and between preliminarily stored threshold values and a magnitude of detection signal of the input current detecting part corresponding to a magnitude of detection signal of the switching element current detecting part, wherein, if the material discriminating part judges that the material composition comprises aluminum, the control part controls to operate in the first mode and to operate at least one conduction period of the first, second, third and fourth switching elements longer than one cycle of a period of the resonance current flowing in the heating coil.

15. The inductive heating device according to claim 1 further comprising:

a rectifying part for rectifying a commercial power source and supplying a direct-current voltage to the smoothing part;

an input current detecting part for detecting an input current of the rectifying part;

a resonance output detecting part for detecting the magnitude of a resonance current, and a material discriminating part for discriminating the material by comparison between preliminarily stored threshold values and a magnitude of detection signal of the resonance output detecting part corresponding to a magnitude of detection signal of the input current detecting part, and between the preliminarily stored threshold values and the magnitude of an input current detection signal of the input current detecting part corresponding to the magnitude of the detection signal of the resonance output detecting part, wherein, if the material discriminating part judges that the material composition comprises aluminum, the control part controls to operate in the first mode and to operate at least one conduction period of the first, second, third and fourth switching elements longer than one cycle of a period of the resonance current flowing in the heating coil.

16. The inductive heating device according to claim 2 further comprising:

a rectifying part for rectifying a commercial power source and supplying a direct-current voltage to the smoothing part;

an input current detecting part for detecting an input current of the rectifying part;

a resonance output detecting part for detecting the magnitude of a resonance current, and a material discriminating part for discriminating the material by comparison between preliminarily stored threshold values and a magnitude of a detection signal of the resonance output detecting part corresponding to a magnitude of detection signal of the input current detecting part, and between the preliminarily stored threshold values and a magnitude of the input current detection signal of the input current detecting part corresponding to the magnitude of the detection signal of the resonance output detecting part, wherein, if the material discriminating part judges that the material composition comprises aluminum, the control part controls to operate in the first mode and to operate at least one conduction period of the first, second, third and fourth switching elements longer than one cycle of a period of the resonance current flowing in the heating coil.

17. The inductive heating device according to claim 1 further comprising:

a rectifying part for rectifying a commercial power source and supplying a direct-current voltage to the smoothing part;

an input current detecting part for detecting an input current of the rectifying part;

a switching element current detecting part for detecting an electric current of the first, second, third or fourth switching element;

a material discriminating part for discriminating the material to be heated by comparison between preliminarily stored threshold values and a magnitude of detection signal of the switching element current detecting part corresponding to a magnitude of detection signal of the input current detecting part, and between preliminarily stored threshold values and the magnitude of the detection signal of the input current detecting part corresponding to the magnitude of the detection signal of the switching element current detecting part; and a changeover part for changing over the capacity of the resonance capacitor, wherein the control part controls to operate the changeover part so that the capacity of the resonance capacitor is larger when the material discriminating part judges the material to comprise iron than when the material discriminating part judges the material to comprise aluminum.

18. The inductive heating device according to claim 2 further comprising:

a rectifying part for rectifying a commercial power source and supplying a direct-current voltage to the smoothing part;

an input current detecting part for detecting an input current of the rectifying part;

a switching element current detecting part for detecting an electric current of the first, second, third or fourth switching element;

a material discriminating part for discriminating the material by comparison between preliminarily stored threshold values and a magnitude of a detection signal of the switching element current detecting part corresponding to a magnitude of a detection signal of the input current detecting part, and between the preliminarily stored threshold values and the magnitude of detection signal of the input current detecting part corresponding to the magnitude of the detection signal of the switching element current detecting part; and a changeover part for changing over the capacity of the resonance capacitor, wherein the control part controls to operate the changeover part so that the capacity of the resonance capacitor is larger when the material discriminating part judges the material to comprise iron than when the material discriminating part judges the material to comprise aluminum.

19. The inductive heating device according to claim 1 further comprising:

a rectifying part for rectifying a commercial power source and supplying a direct-current voltage to the smoothing part;

an input current detecting part for detecting an input current of the rectifying part;

a resonance output detecting part for detecting the magnitude of a resonance current;

a material discriminating part for discriminating the material by comparison between preliminarily stored threshold values and a magnitude of a detection signal of the resonance output detecting part corresponding to a magnitude of a detection signal of the input current detecting part, and between the preliminarily stored threshold stored values and a magnitude of a detection signal of the input current detecting part corresponding to the magnitude of the detection signal of the resonance output detecting part; and a changeover part for changing over the capacity of the resonance capacitor, wherein the control part controls to operate the changeover part so that the capacity of the resonance is larger when the material discriminating part judges the material to comprise iron than when the material discriminating part judges the material to comprise aluminum.

20. The inductive heating device according to claim 2 further comprising:

a rectifying part for rectifying a commercial power source and supplying a direct-current voltage to the smoothing part;

an input current detecting part for detecting an input current of the rectifying part;

a resonance output detecting part for detecting the magnitude of a resonance current, a material discriminating part for discriminating the material by comparison between preliminarily stored threshold values and a magnitude of a detection signal of the resonance output detecting part corresponding to a magnitude of a detection signal of the input current detecting part, and between the preliminarily stored threshold values and a magnitude of a detection signal of the input current detecting part corresponding to the magnitude of detection signal of the resonance output detecting part; and a changeover part for changing over the capacity of the resonance capacitor, wherein the control part controls to operate the changeover part so that the capacity of the resonance is larger when the material discriminating part judges the material to comprise iron than when the material discriminating part judges the material to comprise aluminum.

* * * * *